US011718107B2

(12) United States Patent
Liu et al.

(10) Patent No.: US 11,718,107 B2
(45) Date of Patent: Aug. 8, 2023

(54) AIRFLOW CONTROL IN A PRINTING SYSTEM VIA MEDIA REGISTRATION, AND RELATED DEVICES, SYSTEMS, AND METHODS

(71) Applicant: XEROX CORPORATION, Norwalk, CT (US)

(72) Inventors: Chu-Heng Liu, Penfield, NY (US); Douglas K. Herrmann, Webster, NY (US); Jason M. LeFevre, Penfield, NY (US); Paul J. McConville, Webster, NY (US); Seemit Praharaj, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 93 days.

(21) Appl. No.: 17/218,900

(22) Filed: Mar. 31, 2021

(65) Prior Publication Data

US 2022/0314654 A1 Oct. 6, 2022

(51) Int. Cl.
*B41J 29/38* (2006.01)
*B41J 11/00* (2006.01)

(52) U.S. Cl.
CPC ..... *B41J 11/0085* (2013.01)

(58) Field of Classification Search
None
See application file for complete search history.

(56) References Cited

U.S. PATENT DOCUMENTS 6,719,398 B1 * 4/2004 McElfresh ..... B41J 2/04586 347/34
8,388,246 B2 3/2013 Spence et al.
9,944,094 B1 4/2018 Herrmann et al.
10,688,778 B2 6/2020 Fromm et al.
2019/0135565 A1 * 5/2019 Kaburagi ..... B65H 5/02

FOREIGN PATENT DOCUMENTS

EP 1 319 510 B1 9/2009
GB 2 374 834 A 10/2002

OTHER PUBLICATIONS

Estricher M, Printer, Mar. 22, 2019, China, All Pages (Year: 2019).*

* cited by examiner

*Primary Examiner* — Erica S Lin
*Assistant Examiner* — Tracey M McMillion
(74) *Attorney, Agent, or Firm* — Jones Robb, PLLC

(57) ABSTRACT

A printing system comprises a printhead to eject a print fluid to a deposition region. A movable support surface, such as a belt, is used to transport print media through the deposition region, with the print media being held against the movable support surface by vacuum suction through holes in the movable support surface. A media registration device loads print media onto the movable support surface and registers the print media to a location of the movable support surface. The movable support surface comprises no-suction-regions in which the vacuum suction through the movable support surface is prevented. The no-suction regions extend across the width of the movable support surface in a cross-process direction and are arranged at predetermined intervals along the process direction. The control system causes the media registration device to register each of the print media relative to a respective one of the no-suction-regions.

17 Claims, 11 Drawing Sheets

AIRFLOW CONTROL IN A PRINTING SYSTEM VIA MEDIA REGISTRATION, AND RELATED DEVICES, SYSTEMS, AND METHODS

FIELD

Aspects of this disclosure relate generally to inkjet printing, and more specifically to inkjet printing systems having a media transport assembly utilizing vacuum suction to hold and transport print media. Related devices, systems, and methods also are disclosed.

INTRODUCTION

In some applications, inkjet printing systems use an ink deposition assembly with one or more printheads, and a media transport assembly to move print media (e.g., a substrate such as sheets of paper, envelopes, or other substrate suitable for being printed with ink) through an ink deposition region of the ink deposition assembly (e.g., a region under the printheads). The inkjet printing system forms printed images on the print media by ejecting ink from the printheads onto the media as the media pass through the deposition region. In some inkjet printing systems, the media transport assembly utilizes vacuum suction to assist in holding the print media against a movable support surface (e.g., conveyor belt, rotating drum, etc.) of the transport device. Vacuum suction to hold the print media against the support surface can be achieved using a vacuum source (e.g., fans) and a vacuum plenum fluidically coupling the vacuum source to a side of the movable support surface opposite from the side that supports the print medium. The vacuum source creates a vacuum state in the vacuum plenum, causing vacuum suction through holes in the movable support surface that are fluidically coupled to the vacuum plenum. When a print medium is introduced onto the movable support surface, the vacuum suction generates suction forces that hold the print medium against the movable support surface. The media transport assembly utilizing vacuum suction may allow print media to be securely held in place without slippage while being transported through the ink deposition region under the ink deposition assembly, thereby helping to ensure correct locating of the print media relative to the printheads and thus more accurate printed images. The vacuum suction may also allow print media to be held flat as it passes through the ink deposition region, which may also help to increase accuracy of printed images, as well as helping to prevent part of the print medium from rising up and striking part of the ink deposition assembly and potentially causing a jam or damage.

One problem that may arise in inkjet printing systems that include media transport assemblies utilizing vacuum suction is unintended blurring of images resulting from air currents induced by the vacuum suction. In some systems, such blurring may occur in portions of the printed image that are near the edges of the print media, particularly those portions that are near the lead edge or trail edge in the transport direction (sometimes referred to as process direction) of the print media. During a print job, the print media are spaced apart from one another on the movable support surface as they are transported through the deposition region of the ink deposition assembly, and therefore parts of the movable support surface between adjacent print media are not covered by any print media. This region between adjacent print media is referred to herein as the inter-media zone. Thus, adjacent to both the lead edge and the trail edge of each print medium in the inter-media zone there are uncovered holes in the movable support surface. Because these holes are uncovered, the vacuum of the vacuum plenum induces airflow through those uncovered holes. This airflow may deflect ink drops as well as satellites as they are traveling from a printhead to the substrate, and thus cause blurring of the image.

A need exists to improve the accuracy of the placement of droplets in inkjet printing systems and to reduce the appearance of blur of the final printed media product. A need further exists to address the blurring issues in a reliable manner and while maintaining speeds of printing and transport to provide efficient inkjet printing systems.

SUMMARY

Embodiments of the present disclosure may solve one or more of the above-mentioned problems and/or may demonstrate one or more of the above-mentioned desirable features. Other features and/or advantages may become apparent from the description that follows.

In accordance with at least one embodiment of the present disclosure, a printing system comprises an ink deposition assembly, a media transport assembly, and a control system. The ink deposition assembly comprises a printhead arranged to eject a print fluid to a deposition region of the ink deposition assembly. The media transport assembly comprises a movable support surface with holes through the movable support surface, a media registration device, and a source of vacuum suction. The media registration device is configured to load print media onto the movable support surface and register the print media to a location of the movable support surface. The media transport assembly is configured to hold the print media against the movable support surface by vacuum suction through the holes and transport the print media along a process direction though the deposition region. The movable support surface comprises no-suction-regions in which the vacuum suction is prevented, the no-suction-regions extending in a cross-process direction across the movable support surface and being distributed along the movable support surface in the process direction. The control system is configured to cause the media registration device to register each of the print media relative to a respective one of the no-suction-regions.

In accordance with at least one embodiment of the present disclosure, a method of transporting print media through a printing system comprises generating vacuum suction and communicating the vacuum suction through one or more first regions of a movable support surface moving through an ink deposition region of the printing system to apply a suction force. The method further comprises preventing the vacuum suction from being communicated through one or more second regions of the movable support surface moving through the ink deposition region. The method further comprises loading a print medium to the movable support surface such that the print medium is held against the movable support surface by the suction force through the one or more first regions and registered relative to one of the second regions, transporting the print medium through the ink deposition region via the movable support surface, and ejecting print fluid from a printhead to deposit the print fluid to the print medium in the deposition region.

In accordance with at least one embodiment of the present disclosure, a method comprises loading a print medium onto a movable support surface of a media transport assembly of a printing system. The print medium is held against the movable support surface via vacuum suction through holes in the movable support surface. The movable support surface comprises no-suction-regions in which the vacuum suction is prevented in the no-suction regions. The no-suction-regions extend in a cross-process direction across the movable support surface and are distributed along the movable support surface in the process direction. The method further comprises selecting a media registration scheme out of multiple media registration schemes the printing system is configured to use, the multiple media registration schemes including a first media registration scheme in which the trail edge of each print medium is registered against one of the no-suction-regions. The method further comprises registering the print medium using the selected registration scheme, transporting the print medium, via the movable support surface, in a process direction through a deposition region of a printhead of the printing system, and ejecting print fluid from the printhead to deposit the print fluid to the print medium in the deposition region.

BRIEF DESCRIPTION OF THE DRAWINGS

The present disclosure can be understood from the following detailed description, either alone or together with the accompanying drawings. The drawings are included to provide a further understanding of the present disclosure and are incorporated in and constitute a part of this specification. The drawings illustrate one or more embodiments of the present teachings and together with the description explain certain principles and operation. In the drawings.

DETAILED DESCRIPTION

Figure 1A:
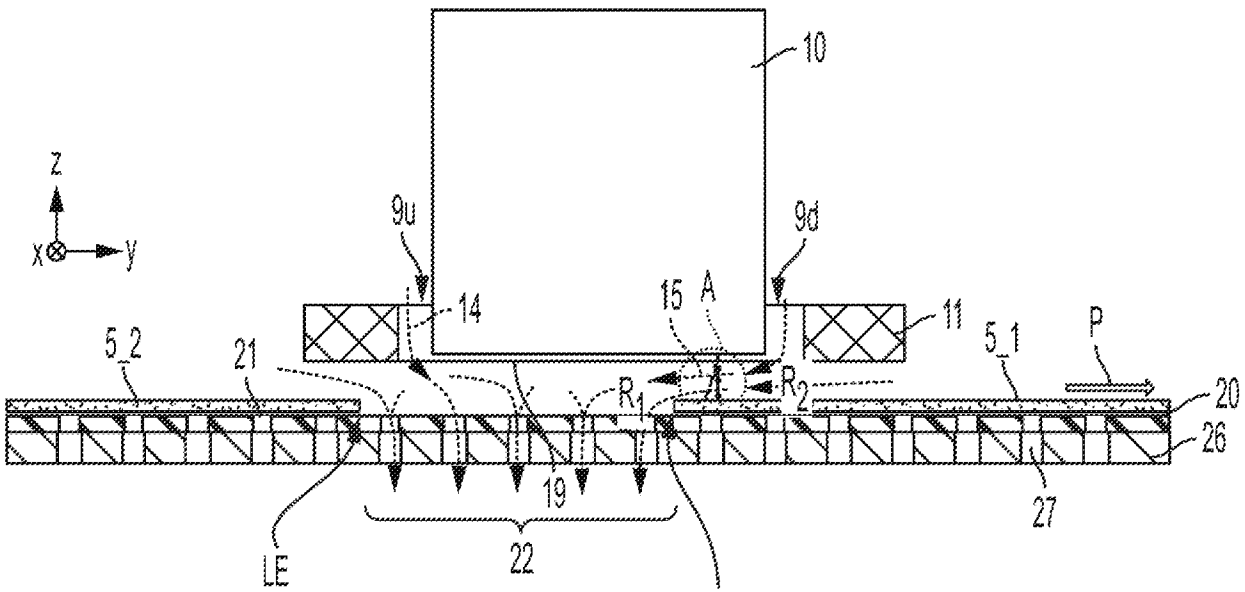
FIG. 1A RELATED ART
FIGS. 1A-1I schematically illustrate air flow patterns relative to a printhead assembly, transport device, and print media during differing stages of print media transport through an ink deposition region of a conventional inkjet printing system, and resulting blur effects in the printed media product.
Figure 1C:
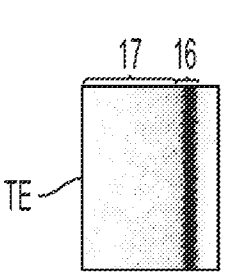
Figure 1B:
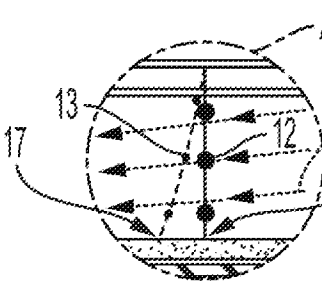
Figure 1D:
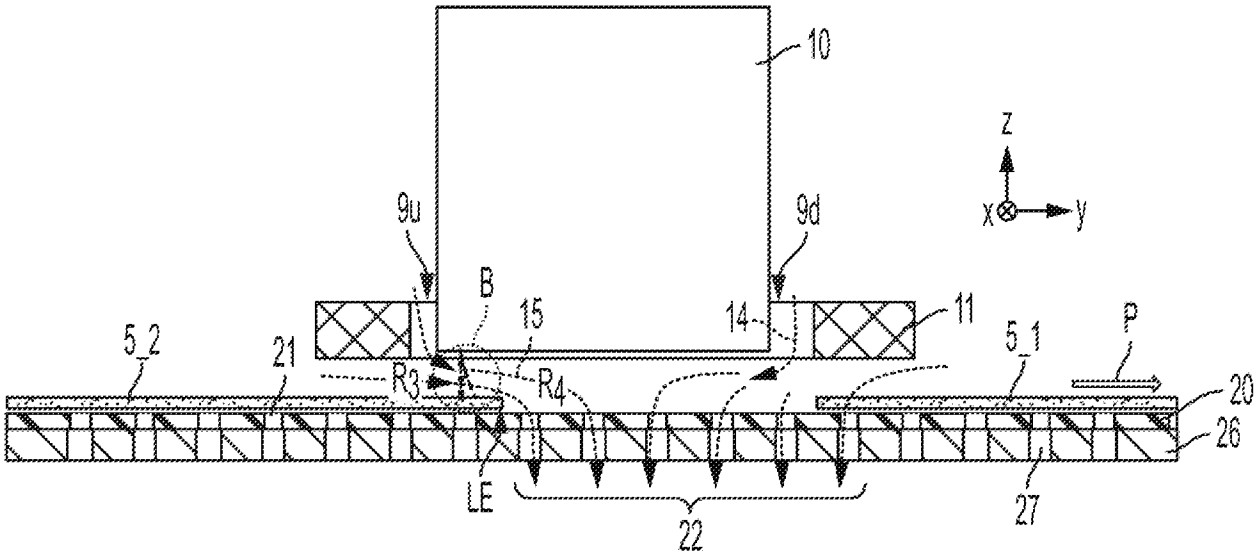
FIG. 1D RELATED ART
Figure 1E:
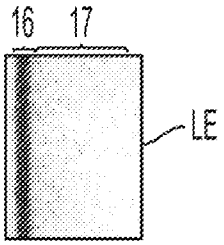
Figure 1F:
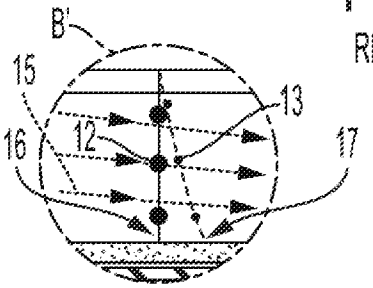
Figure 1G:
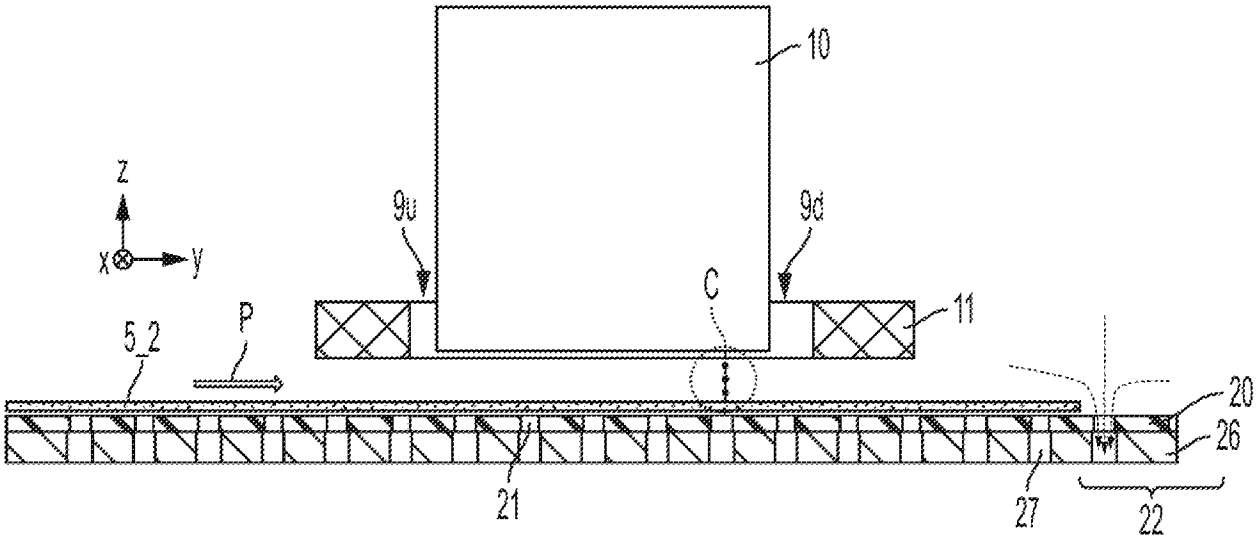
FIG. 1G RELATED ART
Figure 1I:
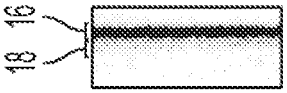
Figure 1H:
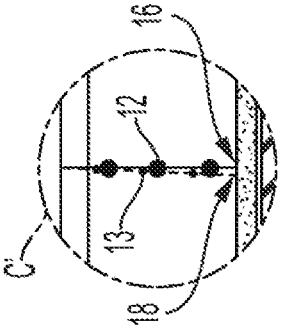

As described above, when an inter-media zone is near or under a printhead, the uncovered holes in the inter-media zone can create crossflows that can blow ink drops (large drops) and satellites (small drops) ejected from a printhead off course and cause image blur. To better illustrate some of the phenomena occurring giving rise to the blurring issues, reference is made to FIGS. 1A-1I. FIGS. 1A, 1D, and 1G illustrate schematically a printhead 10 printing on a print medium 5 near a trail edge TE, a lead edge LE, and a middle portion, respectively, of the print medium 5. FIGS. 1B, 1E, and 1H illustrate enlarged views of the regions A, B, and C, of FIGS. 1A, 1D, and 1G, respectively. FIGS. 1C, 1F, and 1I illustrate enlarged pictures of printed images, the printed images comprising lines printed near the trail edge TE, lead edge LE, and middle portion, respectively, of a sheet of paper.

As shown in FIGS. 1A, 1D, and 1G, the inkjet printing system comprises a printhead 10 to eject ink through an opening 19 in a carrier plate 11 to print media 5 (e.g., print medium 5_1 and 5_2), and a movable support surface 20 that transports the print media 5 in a process direction P, which corresponds to a positive y-axis direction in the Figures. The movable support surface 20 is movable (e.g., slides) along a top of a vacuum platen 26, and a vacuum environment is provided on a bottom side of the platen 26. The movable support surface 20 has holes 21 and the vacuum platen 26 has holes 27, and the holes 21 and 27 periodically align as the movable support surface 20 moves so as to expose the region above the movable support surface 20 to the vacuum below the platen 26. In regions where the print media 5 cover the holes 21, the vacuum suction through the aligned holes 21 and 27 generates a force that holds the print media 5 against the movable support surface 20. However, little or no air flows through these covered holes 21 and 27 since they are blocked by the print media 5. On the other hand, as shown in FIGS. 1A and 1D, in the inter-media zone 22 the holes 21 and 27 are not covered by the print media 5_1, 5_2, and therefore the vacuum suction pulls air to flow down through the holes 21 and 27 in the inter-media zone 22. This creates airflows, indicated by the dashed arrows in FIGS. 1A and 1D, which flow from regions around the printhead 10 towards the uncovered holes 21 and 27 in the inter-media zone 22, with some of the airflows passing under the printhead 10.

In FIG. 1A, the print medium 5_1 is being printed on near its trail edge TE, and therefore the region where ink is currently being ejected ("ink-ejection region") (e.g., region A in FIG. 1A) is located downstream of the inter-media zone 22 (upstream and downstream being defined with respect to the process direction P, which is the direction of transport of the print media by the movable support surface 20). Accordingly, some of the air being sucked towards the inter-media zone 22 will flow upstream through the ink-ejection region A. More specifically, the vacuum suction from the inter-media zone 22 lowers the pressure in the region immediately above the inter-media zone 22, e.g., region $R_1$ in FIG. 1A, while the region downstream of the printhead 10, e.g., region $R_2$ in FIG. 1A, remains at a higher pressure. This pressure gradient causes air to flow in an upstream direction from the region $R_2$ to the region $R_1$, with the airflows crossing through the ink-ejection region (e.g., region A in FIG. 1A) which is between the regions $R_1$ and $R_2$. Some of this air may be pulled from the gap 9*d* between the downstream face of the printhead 10 and a rim of the opening 19 through which the printhead 10 ejects ink. Airflows such as these, which cross through the ink-ejection region, are referred to herein as crossflows 15. In FIG. 1A, the crossflows 15 flow upstream, but in other situations the crossflows 15 may flow in different directions.

As shown in the enlarged view A' in FIG. 1B, which comprises an enlarged view of the region A, as ink is ejected from the printhead 10 towards the medium 5, main ink droplets 12 and satellite ink droplets 13 are formed. The satellite droplets 13 are much smaller than the main droplets 12 and have less mass and momentum, and thus the upstream crossflows 15*a* tend to affect the satellite droplets 13 more than the main droplets 12. Thus, while the main droplets 12 may land on the print medium 5 near their intended deposition location 16 regardless of the crossflows 15, the crossflows 15 may push the satellite droplets 13 away from the intended trajectory so that they land at an unintended location 17 on the medium 5, the unintended location 17 being displaced from the intended location 16. This can be seen in an actual printed image in FIG. 1C, in which the denser/darker line-shaped portion is formed by the main droplets which were deposited predominantly at their intended locations 16, whereas the smaller dots dispersed away from the line are formed by satellite droplets which were blown away from the intended locations 16 to land in unintended locations 17, resulting in a blurred or smudged appearance for the printed line. Notably, the blurring in FIG. 1C is asymmetrically biased towards the trail edge TE of the paper shown, which would be due to the crossflows 15 near the trail edge TE blowing primarily in an upstream direction depicted in FIGS. 1A and 1B. The inter-media zone 22 may also induce other airflows flowing in other directions, such as downstream airflows from an upstream side of the printhead 10, but these other airflows do not pass through the region where ink is currently being ejected in the illustrated scenario and thus do not contribute to image blur. Only those airflows that cross through the ink ejection region are referred to herein as crossflows.

FIGS. 1D-1F illustrate another example of such blurring occurring, but this time near the lead edge LE of the print medium 5_2. The cause of blurring near the lead edge LE as shown in FIGS. 1C and 1D is similar to that described above in relation to the trail edge TE, except that in the case of printing near the lead edge LE the ink-ejection region is now located upstream of the inter-media zone 22. As a result, the crossflows 15 that are crossing through the ink-ejection region now originate from the upstream side of the printhead 10, e.g., from region $R_3$, and flow downstream to region $R_4$ where the uncovered holes of the inter-media zone 22 adjacent the lead edge LE are. For example, air may be pulled from the gap 9*u* between the upstream face of the printhead 10 and the rim of the opening 19 of the carrier plate 11. Thus, as shown in the enlarged view B' of FIG. 1E, which comprises an enlarged view of the ink ejection region B, in the case of printing near the lead edge LE, the satellite droplets 13 are blown downstream towards the lead edge LE of the print medium 5_2 (positive y-axis direction). As shown in FIG. 1F, such a phenomenon results in asymmetric blurring that is biased towards the lead edge LE, in which satellite droplets get deposited at undesired locations 17 relative to the intended location 16.

In contrast, as shown in FIG. 1G and the enlarged view C' in FIG. 1H, which corresponds to an enlarged view of ink ejection region C, when a print medium (e.g., print medium 5_2) is being printed on in a middle portion, farther from the trail and lead edges TE, LE, there may be little or no crossflows 15 because the inter-media zone 22 is too distant from the printhead 10 and the ink-ejection region C to induce much airflow near the ink-ejection region C. Because the crossflows 15 are absent or weak farther away from the edges of the print medium 5, the satellite droplets 13 in this region are not as likely to be blown off course. Thus, as shown in FIGS. 1H and 1I, when printing farther from the edges of the print medium 5_2, the satellite droplets land at locations 18 that are much closer to the intended locations 16 resulting in much less image blurring. The deposition locations 18 of the satellite droplets may still vary somewhat from the intended locations 16, due to other factors affecting the satellite droplets, but the deviation is smaller than it would be near the lead or trail edges, thus not resulting in as noticeable blurring.

Embodiments disclosed herein may, among other things, inhibit some of the crossflows so as to reduce the resulting image blur that may occur. By inhibiting crossflows, the droplets ejected from a printhead (including, e.g., the satellite droplets) are more likely to land closer to or at their intended deposition locations, and therefore the amount of blur can be reduced. In accordance with various embodiments, the movable support surface is provided with multiple no-suction-regions in which suction through the movable support surface is prevented. For example, in some embodiments the holes through the movable support surface may be omitted in the no-suction-regions, or existing holes may be blocked using tape or other patching type materials and processes in the no-suction-regions to prevent suction through the holes. The no-suction-regions can extend across the movable support surface in a cross-process direction and can be distributed at intervals along the process direction. In accordance with various embodiments, airflow control systems disclosed herein may reduce or eliminate the crossflows by controlling the registration of print media that are transported by the movable support surface such that one of the trail edge and the lead edge of each print medium is registered against one of the no-suction-regions. Thus, because the trail edge (or the lead edge) of each print medium is adjacent to one of the no-suction-regions and there are no holes (or the holes are blocked) in the no-suction regions, the vacuum suction from the adjacent inter-media zone that would otherwise induce airflow near that edge is reduced or eliminated. Accordingly, while printing is occurring near the trail edge (or the lead edge), the crossflows near that edge are reduced in strength or eliminated. With the crossflows near the trail edge (or lead edge) of the print media reduced or eliminated, the ink droplets (including the satellite droplets) are more likely to land at or nearer to their intended deposition locations, and therefore the amount of blur near that edge of the print media is reduced.

As noted above, the registration of one of the edges of the print medium against the no-suction-region mitigates image blur near that edge, but does not necessarily mitigate image blur near the opposite edge or cross-pross edge for smaller width print media. Accordingly, in some embodiments, in addition to registering one edge against the no-suction-region, a gap is provided on one side of the printhead while no gap is provided on the other side of the printhead (or the gap is blocked if present) to combat image blur near the edge of the print media that is opposite from the registered edge. For example, in some embodiments in which the trail edge TE is registered against the no-suction-region, a downstream gap is provided on a downstream side of the printhead and no upstream gap is provided (or the upstream gaps is blocked if present), which reduces blur near the lead edge LE. Conversely, in embodiments in which the lead edge LE is registered against the no-suction region, an upstream gap is provided on an upstream side of the printhead and no downstream gap is provided (or the downstream gap is blocked if present), which reduces blur near the trail edge TE. Accordingly, by both registering the print media against the no-suction region and providing the upstream/downstream gaps as described above, image blur near both the lead edge LE and the trail edge TE can be reduced. The reason why providing the gaps as described above reduces image blur are described in greater detail below.

It was found that providing a downstream gap on the downstream side of the printhead while omitting an upstream gap on the upstream side of the printhead (or blocking the upstream gap if present) reduces the amount of image blur near the lead edges LE of the print media. This improvement occurs for two main reasons. First, the presence of the downstream gap allows beneficial relief air to be pulled through the downstream gap into the inter-media zone when the lead edge LE is under the printhead. For example, in the state illustrated in FIG. 1D, relief air 14 flows through the downstream gap 9*d*. The relief air is beneficial because it offsets some of the negative pressure caused by the suction from the inter-media zone, and this results in a lowering of the strength with which air is pulled from elsewhere around the printhead, which reduces the strength with which the crossflows are pulled under the printhead. Because the relief air through the downstream gap reduces the strength of crossflows when the lead edge LE is under the printhead, the amount of image blur near the lead edge LE is reduced. The second reason for improvement in image blur near the lead edge LE is that the omission or blocking of the upstream gap prevents crossflows from being drawn down through the upstream gap when the lead edge LE is under the printhead. An example of such crossflows can be seen in in FIG. 1D, in which some of the crossflows 15 are pulled down through the upstream gap 9*u*. Omitting or blocking the upstream gap does not eliminate all crossflows that occur near the lead edge LE, but it does remove one prominent source of the crossflows that can occur near the lead edge LE and thus it reduces the aggregate strength of the crossflows and thus reduces image blur near the lead edge LE. Thus, both the beneficial relief air provided by the downstream gap and the blocking of crossflows through the upstream gap contribute to reducing the amount of image blur occurring near the lead edge.

Although providing the downstream gap while omitting or blocking the upstream gap tends to reduce image blur near the lead edge LE, it also may contribute to increasing image blur at the trail edge TE if other countermeasures are not taken. This occurs because the air flowing through the downstream gap, while being beneficial relief air when the lead edge LE is under the printhead, becomes a crossflow when the trail edge TE is under the printhead. Similarly, while omitting or blocking the upstream gap prevents some crossflows when the lead edge LE is under the printhead, this also prevents beneficial relief air from being provided when the trail edge TE is under the printhead. Accordingly, improving image blur at the lead edge LE through the approach described above can come at the cost of worsening image blur at the trail edge TE if other countermeasures are not taken. However, in embodiments in which the trail edge TE is registered to the no-suction region, there is little to no suction from the inter-media zone near the trail edge TE and therefore above-noted worsening of image blur near the trail edge TE due to gaps around the printhead does not occur. Thus, in some embodiments the registering of the trail edge TE against the no-suction region is beneficially paired with the providing of the open downstream gap and omitting/blocking the upstream gap, thus allowing for satisfactory reduction of image blur at both the trail edge TE and the lead edge LE simultaneously.

Conversely, if the gaps which are open and blocked are reversed (i.e., the upstream gap is open while the downstream gap is omitted or blocked), this reduces the amount of image blur near the trail edge TE rather than the lead edge LE. This reduction in image blur occurs for similar reasons to those described above with respect to the lead edge LE, except that in relation to the lead edge LE the beneficial relief air now comes from the upstream gap and the crossflows tend to come from the downstream gap. In addition, this improvement to image blur at the lead edge LE by providing an open upstream gap while omitting or blocking a downstream gap can come at the cost of worsening image blur at the trail edge TE if countermeasures are not taken. However, in embodiments in which the lead edge LE is registered to the no-suction region, there is little to no suction from the inter-media zone near the lead edge LE and therefore above-noted worsening of image blur near the lead edge LE due to gaps around the printhead does not occur. Thus, in some embodiments the registering of the lead edge LE against the no-suction region is beneficially paired with the providing of the open upstream gap and omitting/blocking the downstream gap, thus allowing for satisfactory reduction of image blur at both the trail edge TE and the lead edge LE simultaneously.

Figure 2:
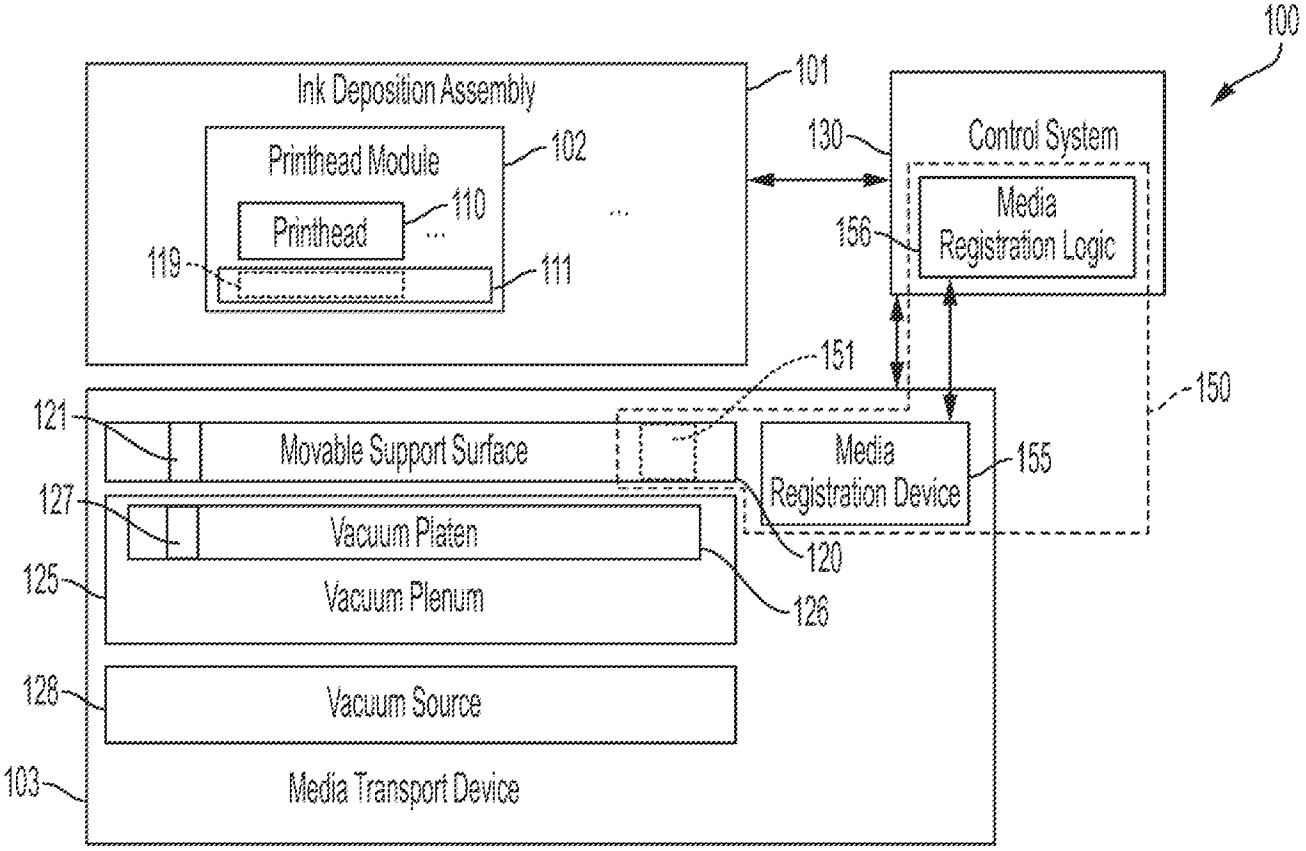
FIG. 2 comprises is a block diagram illustrating components of an embodiment of an inkjet printing system including an air flow control system.

Turning now to FIG. 2, an embodiment of a printing system will be described in greater detail. In the Figures and the description herein, numerical indexes such as "_1", "_2", etc. are appended to the end of the reference numbers of some components. When there are multiple similar components and it is desired to refer to a specific one of those components, the same base reference number is used and different indexes are appended to it to distinguish individual components. However, when the components are being referred to generally or collectively without a need to distinguish between specific ones, the index may be omitted from the base reference number. Thus, as one example, a print medium 5 may be labeled and referred to as a first print medium 5_1 when it is desired to identify a specific one of the print media 5, as in FIG. 1A, but it may also be labeled and referred to as simply a print medium 5 in other cases in which it is not desired to distinguish between multiple print media 5. In addition, letters such as "a", "b", "u", "d", etc. are appended to the end of the reference numbers of some components.

FIG. 2 is a block diagram schematically illustrates a printing system 100 utilizing the above-described airflow control system. The printing system 100 comprises an ink deposition assembly 101 to deposit ink on print media, a media transport assembly 103 to transport print media through the ink deposition assembly 101, and a control system 130 to control operations of the printing system 100. These components of the printing system 100 are described in greater detail in turn below. In addition, various components of the printing system 100 participate in controlling airflow around the printheads, and thus these parts may be referred to collectively as an airflow control system 150.

The ink deposition assembly 101 comprises one or more printhead modules 102. One printhead module 102 is illustrated in FIG. 2 for simplicity, but any number of printhead modules 102 may be included in the ink deposition assembly 101. In some embodiments, each printhead module 102 may correspond to a specific ink color, such as cyan, magenta, yellow, and black. Each printhead module 102 comprises one or more printheads 110 configured to eject print fluid, such as ink, onto the print media to form an image. In FIG. 2, one printhead 110 is illustrated in the printhead module 102 for simplicity, but any number of printheads 110 may be included per printhead module 102. The printhead modules 102 may comprise one or more walls, including a bottom wall which may be referred to herein as a carrier plate 111. The carrier plate 111 comprises printhead openings 119, and the printheads 110 are arranged to eject their ink through the printhead openings 119. In some embodiments, the carrier plate 111 supports the printheads 110. In other embodiments, the printheads 110 are supported by other structures. The printhead modules 102 may also include additional structures and devices to support and facilitate operation of the printheads 110, such as, ink supply lines, ink reservoirs, electrical connections, and so on, as known in the art.

As shown in FIG. 2, the media transport assembly 103 comprises a movable support surface 120, a vacuum plenum 125, a vacuum source 128, and a media registration device 155. The movable support surface 120 transports the print media through a deposition region of the ink deposition assembly 101. The vacuum plenum 125 supplies vacuum suction from the vacuum source 128 to one side of the movable support surface 120 (e.g., a bottom side), and print media is supported on an opposite side of the movable support surface 120 (e.g., a top side). Holes 121 through the movable support surface 120 communicate the vacuum suction through the surface 120, such that the vacuum suction holds down the print media against the surface 120. The media registration device 155 loads the print media onto the movable support surface 120 and registers the print media relative to various registration datums.

The movable support surface 120 is movable relative to the ink deposition assembly 101, and thus the print media held against the movable support surface 120 is transported relative to the ink deposition assembly 101 as the movable support surface 120 moves. Specifically, the movable support surface 120 transports the print media through a deposition region of the ink deposition assembly 101, the deposition region being a region in which print fluid (e.g., ink) is ejected onto the print media, such as a region under the printhead(s) 110. The movable support surface 120 can comprise any structure capable of being driven to move relative to the ink deposition assembly 101 and which has holes 121 to allow the vacuum suction to hold down the print media, such as a belt, a drum, etc.

The vacuum plenum 125 comprises baffles, walls, or any other structures arranged to enclose or define an environment in which a vacuum state (e.g., low pressure state) is maintained by the vacuum source 128, with the plenum 125 fluidically coupling the vacuum source 128 to the movable support surface 120 such that the movable support surface 120 is exposed to the vacuum state within the vacuum plenum 125. In some embodiments, the movable support surface 120 is supported by a vacuum platen 126, which may be a top wall of the vacuum plenum 125. In such an embodiment, the movable support surface 120 is fluidically coupled to the vacuum in the plenum 125 via holes 127 through the vacuum platen 126. In some embodiments, the movable support surface 120 is itself one of the walls of the vacuum plenum 125 and thus is exposed directly to the vacuum in the plenum 125. The vacuum source 128 may be any device configured to remove air from the plenum 125 to create the low-pressure state in the plenum 125, such as a fan, a pump, etc.

The movable support surface 120 comprises no-suction-regions 151, as described above. The no-suction-regions 151 comprise portions of the movable support surface 120 that do not permit fluidic communication of the vacuum suction through the movable support surface 120. In some embodiments, the no-suction-regions 151 comprise portions of the media support surface 120 in which there are no holes 121. In other embodiments, the no-suction-regions 151 comprise portions of the media support surface 120 in which holes 121 are blocked, such as, for example, by covering or filling the holes 121 with a material (e.g., tape). The no-suction-regions 151 each extend across the movable support surface 120 in a cross-process direction and are distributed at intervals along the process direction.

A purpose of the no-suction-regions 151 is to reduce the amount of suction that occurs near a lead or trail edge of the print media, as described above, and in order to do this the no-suction regions 151 each need to extend a sufficient width in the process direction. Thus, it should be understood that references herein to no-suction-regions are not referring to the normal spaces that exist between adjacent holes 121 or between adjacent rows of holes 121 in a movable support surface. Instead, each no-suction-region 151 extends in the process direction sufficiently far to occupy the space that would have been occupied by at least multiple rows of the holes 121 if the no-suction region 151 were absent. In other words, if the pitch (spacing) between adjacent rows of holes 121 in the process direction is $d_1$, then the width of the no-suction-region 151 in the process direction is at least $N \cdot d_1$, where N is two or more. The specific width of the no-suction regions 151 in the process direction may vary from system to system and may be selected based on considerations such as the desired gap between adjacent print media (wider no-suction-regions may entail larger gaps between print media) and the desired amount of blur reduction (wider no-suction-regions may result in better blur reduction, to a point). An optimal width of the no-suction-regions 151 for a given system and a given set of design goals may be determined experimentally, for example by testing different widths of no-suction-regions 151 and measuring the amount of image blur for each different width. In some embodiments, the width of the no-suction-regions 151 in the process direction may be equal to the width of the ink deposition region of a single printhead 110 in the process direction. In some embodiments, the width of the no-suction regions 151 in the process direction may be equal to the width of a printhead 110 in the process direction. In some embodiments, the width of the no-suction regions 151 in the process direction may be equal to the width of a printhead module 102 in the process direction. In some embodiments, the width of the no-suction-region 151 may be at least 15 mm. In some embodiments, the width of the no-suction-region 151 may be at least 25 mm.

The spacing between adjacent no-suction-regions 151 in the process direction may be any desired spacing. In some embodiments, the spacing is set to approximately fit one or more sizes of print media that the printing system 100 is designed to use. For example, in one embodiment in which the movable support surface 120 is around 2060 mm long, the no-suction-regions 151 are spaced around 257 mm apart (center-to-center distance), which may facilitate the usage of various standard sizes of print media. In some embodiments, the spacing between no-suction-regions is set to fit a longest print media the system is designed to use. In some embodiment, the spacing between no-suction regions 151 is not uniform. For example, in some embodiments, a spacing between no-suction regions may alternate between a small spacing (e.g., corresponding to smallest size of print media) and a larger spacing.

As noted above, the media registration device 155 loads the print media onto the movable support surface 120 and registers the print media relative to various registration datums, as those of ordinary skill in the art are familiar with. A process-direction registration datum extends in the process direction and is fixed relative to the transport device 103 (see, for example, the process direction registration datums Reg_P in FIGS. 4, 6, and 7). As each print medium is loaded onto the movable support surface 120, an edge of the print medium that runs along the process direction is aligned to the process-direction registration datum. Herein, whichever side of the media transport assembly 103 that is closest to the process-direction registration datum Reg_P is referred to as the outboard side of the media transport assembly 103, while the opposite side is referred to as the inboard side. For example, in FIG. 4 the right side of the platen 326 is the outboard side. In practice, the registration datum Reg_P could be located on either side of the media transport assembly 103, and thus the side of the media transport assembly 103 that is considered the outboard side will vary from system to system (or from time to time within the same system) depending on which side the print media happen to be registered to. In addition, multiple cross-process registration datums extend in the cross-process direction (see, for example, the cross-process registration datums Reg_CP in FIG. 6). Unlike the process-direction registration datum, the cross-process registration datums move in a fixed manner with the movable support surface 120, in the process direction. As each print medium is loaded onto the movable support surface 120, an edge of the print medium that runs along the cross-process direction (lead edge LE or trail edge TE) is aligned to one of the cross-process registration datums. Thus, by registering each print medium to the process-direction registration datum and one of the cross-process registration datums, a precise location and orientation of the print medium relative to the movable support surface 120 may be enforced, thus allowing for accurate printing of images on the print medium. As will be discussed in greater detail below, in embodiments disclosed herein, the cross-process datums are part of the no-suction-regions 151, meaning that each cross-process datum is located at a boundary of or within one of the no-suction-regions 151.

Note that the registration datums correspond to lines or axes that exist conceptually, but there is not necessarily a physical feature that corresponds to the datums. For example, the process-direction registration datum may correspond to a line that is a certain distance from an edge of the movable support surface, but there is not necessarily any feature on the movable support surface that represents this line.

Various media registration devices for loading print media onto a movable support surface and registering the print media relative to the movable support surface are known in the art and used in existing printing systems. Any existing media registration device, or any new media registration device, may be used as the media registration device 155. Because the structure and function of such media registration devices are well known in the art, further detailed description of such systems is omitted.

The control system 130 comprises processing circuitry to control operations of the printing system 100. The processing circuitry may include one or more electronic circuits configured with logic for performing the various operations described herein. The electronic circuits may be configured with logic to perform the operations by virtue of including dedicated hardware configured to perform various operations, by virtue of including software instructions executable by the circuitry to perform various operations, or any combination thereof. In examples in which the logic comprises software instructions, the electronic circuits of the processing circuitry include a memory device that stores the software and a processor comprising one or more processing devices capable of executing the instructions, such as, for example, a processor, a processor core, a central processing unit (CPU), a controller, a microcontroller, a system-on-chip (SoC), a digital signal processor (DSP), a graphics processing unit (GPU), etc. In examples in which the logic of the processing circuitry comprises dedicated hardware, in addition to or in lieu of the processor, the dedicated hardware may include any electronic device that is configured to perform specific operations, such as an Application Specific Integrated Circuit (ASIC), a Field Programmable Gate Array (FPGA), a Complex Programmable Logic Device (CPLD), discrete logic circuits, a hardware accelerator, a hardware encoder, etc. The processing circuitry may also include any combination of dedicated hardware and general-purpose processor with software.

The processing circuitry of the control system 130 is configured with media registration logic 156, among other things. The media registration logic 156 controls the operation of the media registration device 155. In particular, the media registration logic 156 controls where the cross-process registration datum are located, thus controlling the location to which the media registration device registers print media. The media registration logic 156 controls the registration of the print media such that either a lead edge or a trail edge of a print medium is registered against one of the no-suction-regions 151. In other words, the media registration logic sets the cross-process registration datum to be at a boundary of, or within, the no-suction-regions 151, and causes the media registration device 155 to align either a lead edge or a trail edge with that registration datum. In some embodiments, the trail edge is registered against the no-suction-regions 151. In some embodiments the lead edge is registered against the no-suction-regions 151. In some circumstances, it may be advantageous to register the trail edge against the no-suction regions because the trail edge of the print medium is less likely to lift off the movable support surface 120 when it is located near or in the no-suction region 151. An example of a registration scheme in which the trail edges of the print media are registered against the no-suction-regions 151 is described in greater detail below with respect to FIG. 6.

In some embodiments, the media registration logic 156 may include additional registration schemes besides the scheme described above and may switch between the registration schemes based on user selection or based on detected conditions. For example, the registration scheme described above is designed to reduce image blur, and thus it may be used when a user selects a setting that prioritizes reducing image blur or when it is otherwise determined that image blur mitigation may be needed based on detected conditions (e.g., based on real time feedback of measured image blur). Other registration schemes may prioritize things such as print speed, i.e., number of sheets per minute. Switching between different media registration schemes is described in greater detail below with reference to the embodiment of FIGS. 7A and 7B.

It should be understood that the control system 130 may include more than one individual circuits or units, and these individual circuits or units do not have to be collocated or physically or logically coupled together. Thus, the control system 130 may be a collection of disparate parts, some of which may be located in one device or enclosure and otherwise of which may be located in other devices or enclosures. In other words, the control system 130 includes all of the various circuits that participate in controlling the operations of the printing system 100, regardless of how those circuits happen to be packaged or where those circuits are located. For example, in some embodiments, processing circuitry that is physically located within a same device enclosure as the media registration device 155 is programmed with the media registration logic 156, while other processing circuitry of the control system 130, such as a general-purpose processor or main controller of the printing system 100, is located in a different portion of the printing system 100. As another example, in some embodiments a general-purpose processor or main controller of the printing system 100 is configured with the media registration logic 156.

Although not illustrated in FIG. 2, in some embodiments, the airflow control system 150 may also block off one of the upstream or downstream gaps associated with each printhead 110, while leaving the other gap open. In particular, in embodiments in which the trail edge of the print medium is registered to the no-suction-region 151, then the upstream gap (i.e., the gap between the upstream face of the printhead 110 and the rim of the opening 119) is blocked, while the downstream gap (i.e., the gap between the downstream face of the printhead 110 and the rim of the opening 119) is left open. Conversely, in embodiments in which the lead edge of the print medium is registered to the no-suction-region 151, then the downstream gap is blocked, while the upstream gap is left open. In some embodiments, the gap that is to be blocked can be blocked by a blocking member (e.g., the blocking member 352) which is positioned above or in the corresponding gap to block the gap. In other embodiments, the gap that is to be blocked can be effectively blocked by virtue of being eliminated by placing the printhead 110 against (or very near) the rim of the opening 119 on one side thereof. For example, the upstream gap can be "blocked" by positioning the printhead 110 against (or very near) the upstream side of the opening 119. Accordingly, references herein and in the claims to "blocking" an upstream gap or a downstream gap should be understood as broadly encompassing both using a blocking member to block the gap or effectively blocking the gap by eliminating the gap through positioning the printhead 110 against or near the rim of the opening.

Above, the no-suction-regions are described as regions in which no suction is provided. However, in some embodiments the no-suction regions could be replaced with reduced-suction regions, which are portions of the movable support surface in which suction is not entirely eliminated but is instead significantly reduced as compared to other portions of the movable support surface. For example, the reduced-suction regions could be regions in which the density of holes and/or the size of the holes in the movable support surface is significantly reduced as compared to the rest of the movable support surface. Significantly reduced suction through the no-suction regions means reduced by at least 50% or more, for example, by reducing the density or size of holes by 50% or more. This reduction in the amount of suction in the reduced-suction regions will still have an effect of reducing the strength with which crossflows are induced, albeit perhaps not as effectively as the no-suction regions. In addition, some hold down force may still be applied in cases in which print media happen to overlap the reduced-suction region. Other aspects described herein in relation to the no-suction regions, such as registration of the print media, would still be applicable except that the reduced suction regions would replace the no-suction regions.

Turning now to FIGS. 3-7B, various embodiments of printing systems will be described, which can be used as the printing system 100.

Figure 3:
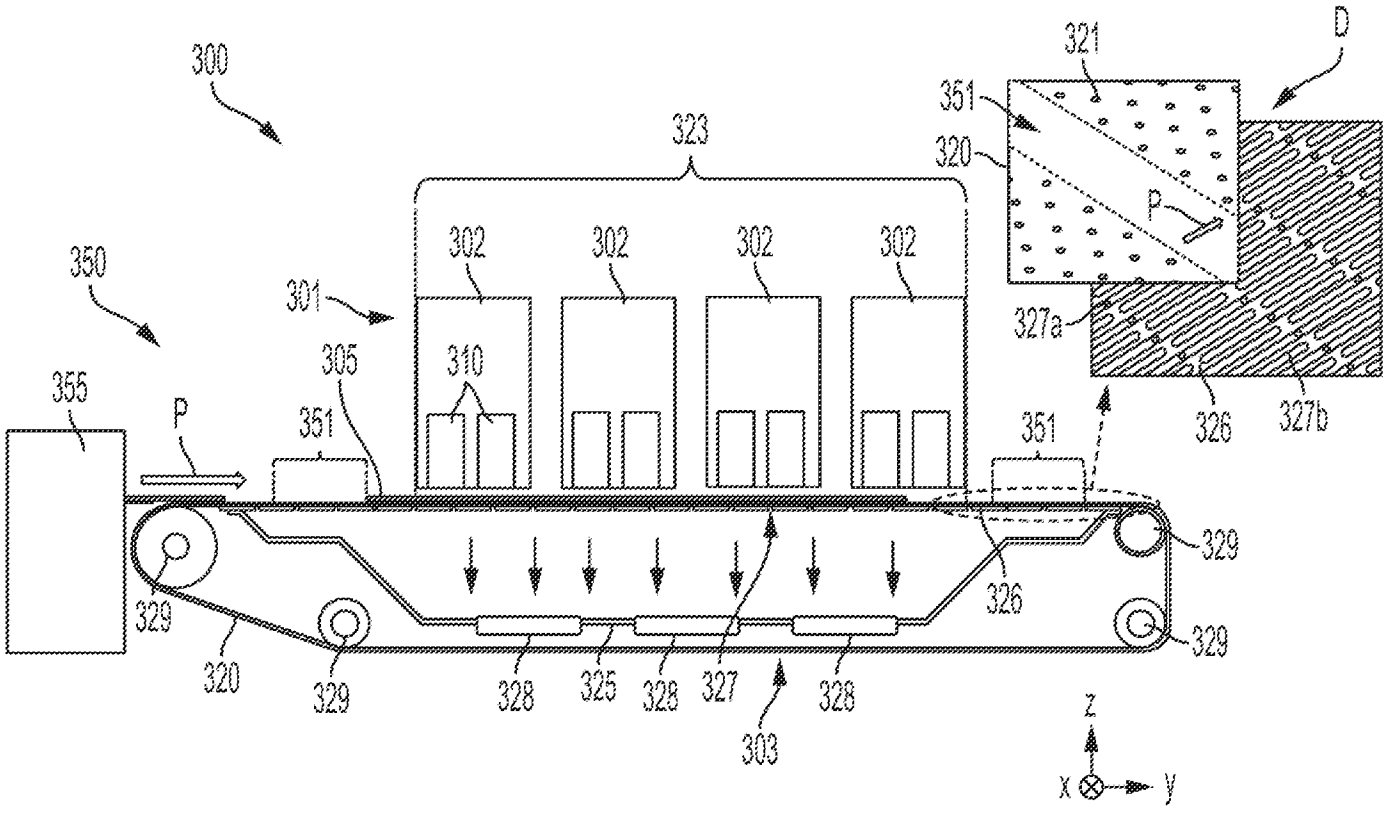
FIG. 3 is a schematic illustration of an ink deposition assembly, media transport assembly, and air flow control air flow control system of one embodiment of an inkjet printing system.
Figure 4:
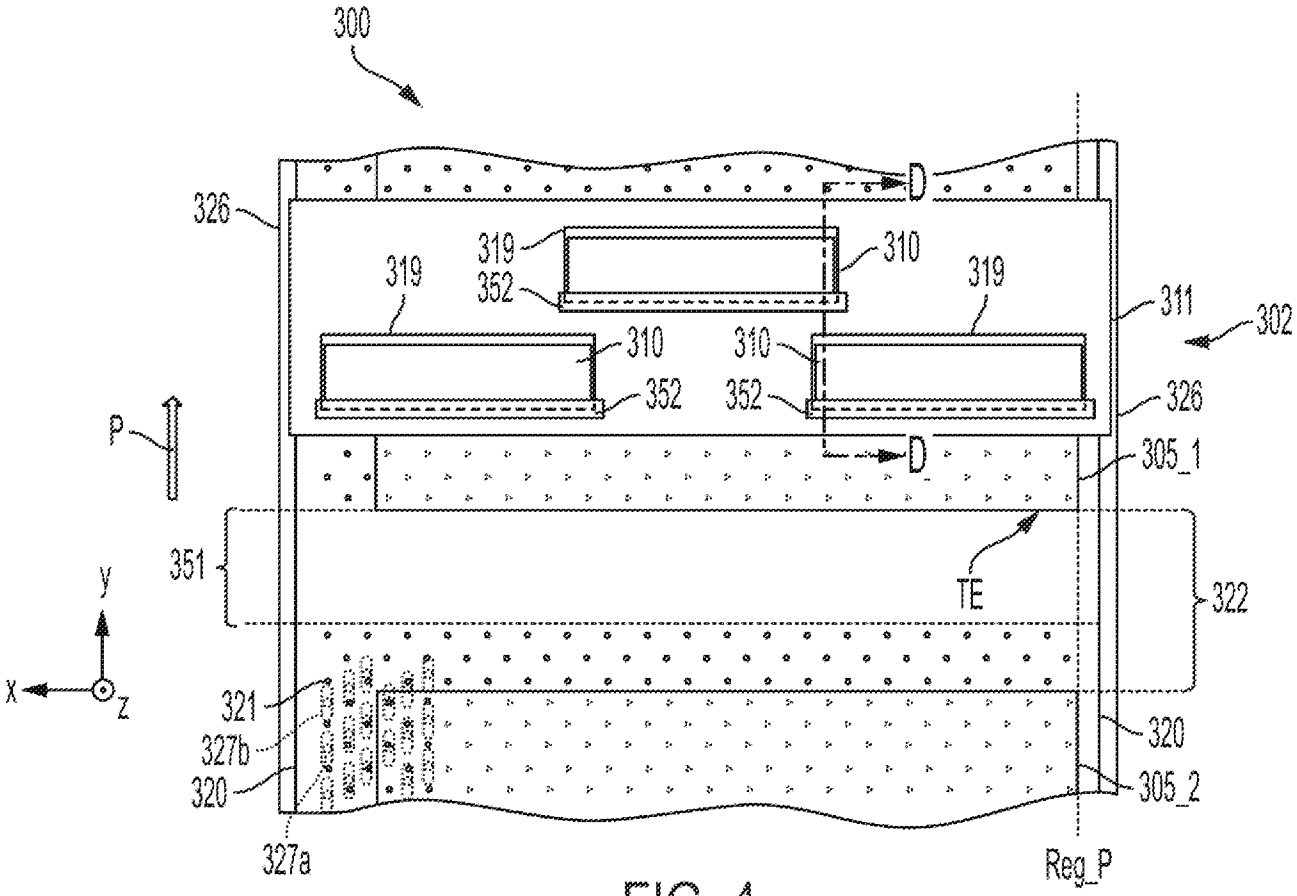
FIG. 4 is a plan view from above the printhead assembly of the inkjet printing system of FIG. 3.
Figure 5A:
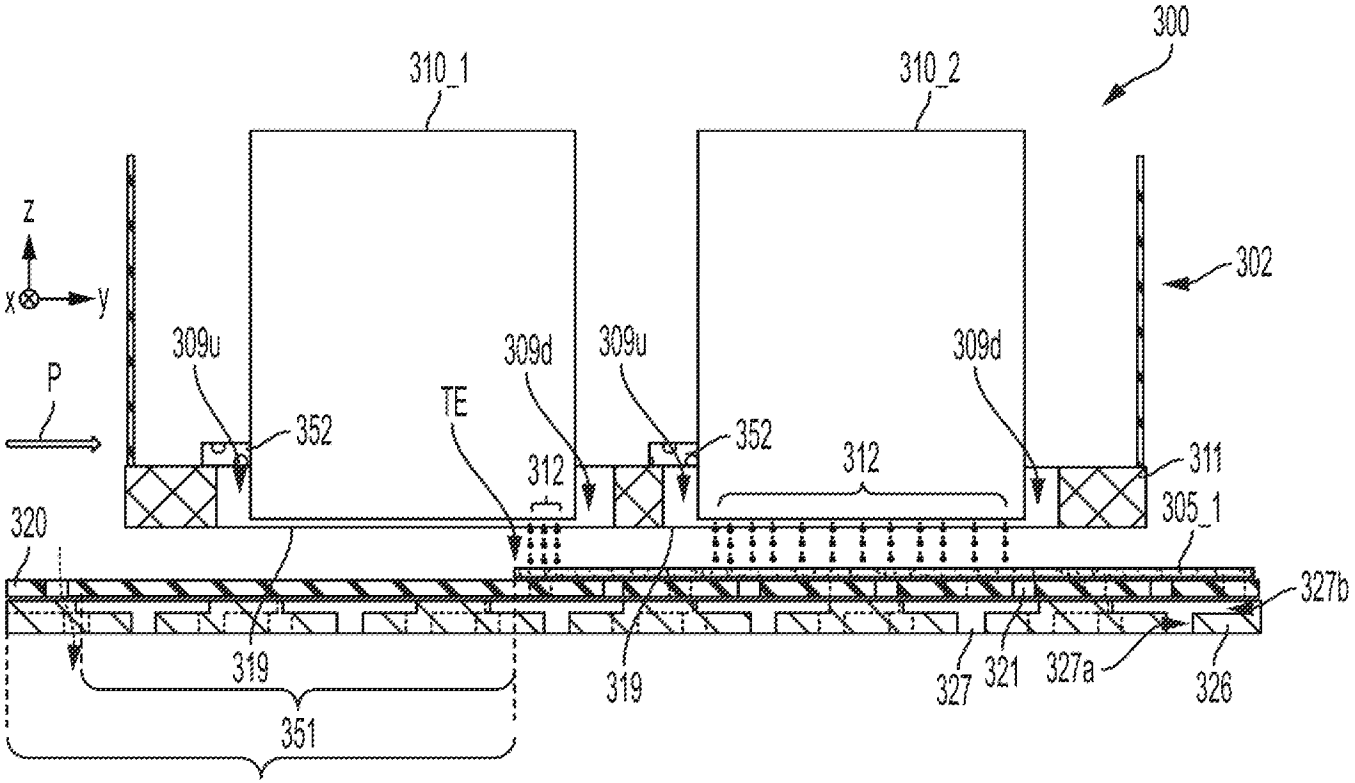
FIGS. 5A-5B are cross-sectional views of the inkjet printing system of FIG. 4, with the cross-section taken along D in FIG. 4.
Figure 5B:
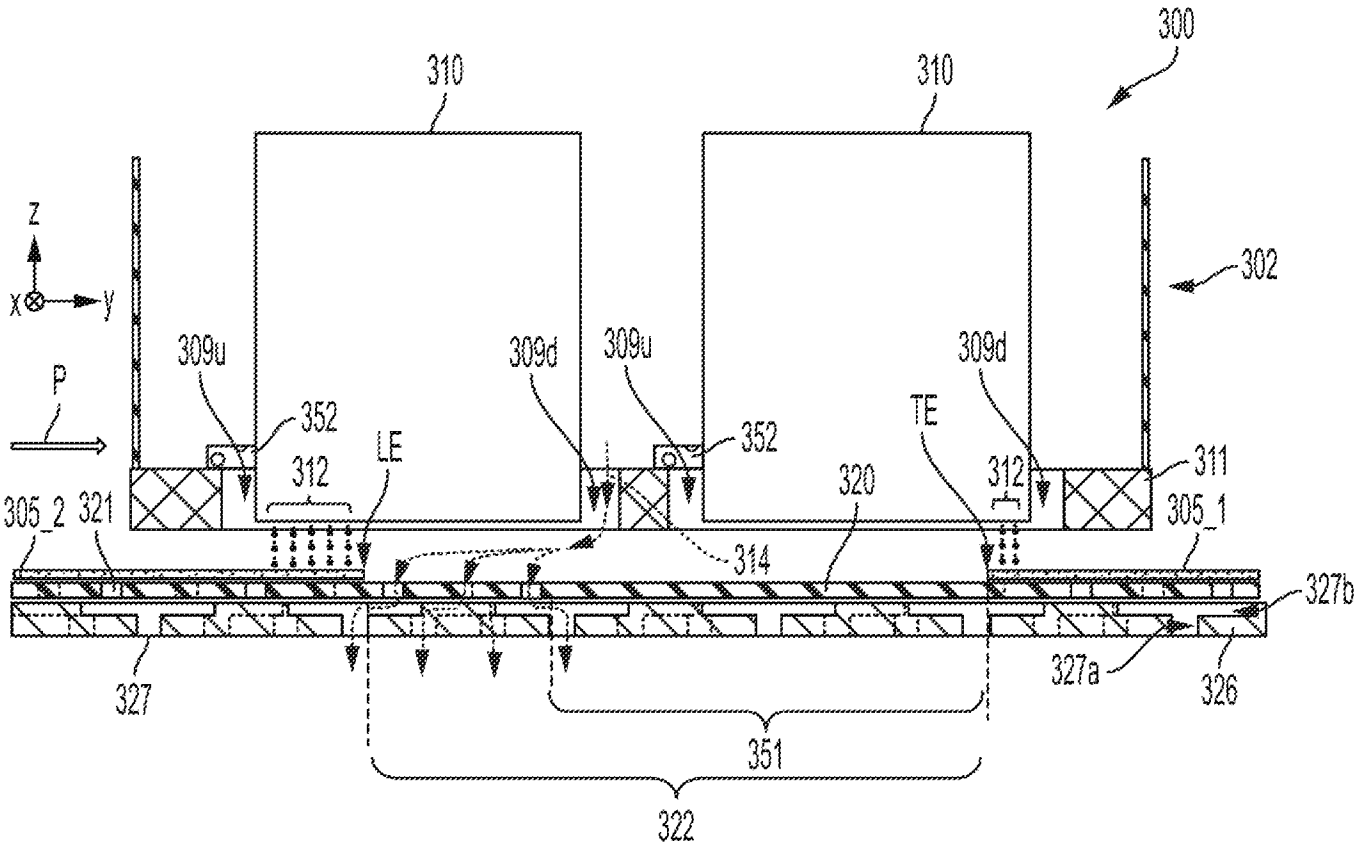

FIGS. 3-5B illustrate a printing system 300, which may be used as the printing system 100 described above with reference to FIG. 2. FIG. 3 comprises a schematic illustrating a portion of the printing system 300 from a side view. FIG. 4 comprises a plan view from above a portion of the printing system 300. In FIG. 4, some components that would not otherwise be visible in the view because they are positioned below other components are illustrated with dashed or dotted lines. FIGS. 5A and 5B comprise cross-sections of the printing system 300 with the section taken along D in FIG. 4.

As illustrated in FIG. 3, the printing system 300 comprises an ink deposition assembly 301, a media transport assembly 303, and an airflow control system 350, which can be used as the ink deposition assembly 101, media transport assembly 103, and airflow control system 150, respectively. The printing system 300 may also comprise additional components not illustrated in FIGS. 3-5B, such as a control system (e.g., the control system 130).

In the printing system 300, the ink deposition assembly 301 comprises four printhead modules 302 as shown in FIG. 3, with each module 302 having three printheads 310 as shown in FIG. 4. As shown in FIG. 3, the printhead models 302 are arranged in series along a process direction P above the media transport assembly 303, such that the print media 305 is transported sequentially beneath each of the printhead modules 302. The printheads 310 are arranged to eject print fluid (e.g., ink) through respectively corresponding printhead openings 319 in a corresponding carrier plate 311, with a bottom end of the printhead 310 extending down partway into the printhead openings 319. In this embodiment, as shown in FIG. 4, the printheads 310 are arranged in an offset pattern with one of the printheads 310 being further upstream or downstream than the other two printheads 310 of the same printhead module 302. In other embodiments, different numbers and/or arrangements of printheads 310 and/or printhead modules 302 are used.

In the printing system 300, media transport assembly 303 comprises a flexible belt providing the movable support surface 320. As shown in FIG. 3, the movable support surface 320 is driven by rollers 329 to move along a looped path, with a portion of the path passing through the ink deposition region 323 of the ink deposition assembly 301. Furthermore, in this embodiment, the vacuum plenum 325 comprises a vacuum platen 326, which forms a top wall of the plenum 325 and supports the movable support surface 320. The platen 326 comprises platen holes 327, which allow fluidic communication between the interior of the plenum 325 and the underside of the movable support surface 320.

In some embodiments, the platen holes 327 may include channels on a top side thereof, as seen in the expanded cutaway of FIG. 3, which may increase an area of the opening of the holes 327 on the top side thereof. Specifically, the platen holes 327 may include a bottom portion 327*a* which opens to a bottom side of the platen 326 and a top portion 327*b* which opens to a top side of the platen 326, with the top portion 327*b* being differently sized and/or shaped than the bottom portion 327*a*. For example, FIGS. 3-5E illustrate an embodiment of the platen holes 327 in which the top portion 327*b* is a channel elongated in the process direction while the bottom portion 327*an* is a through-hole that is less-elongated and has a smaller sectional area (see the enlargement D in FIG. 3 and the dashed-lines in FIG. 4). In some embodiments, multiple holes 327 may share the same top portion 327*b*, or in other words multiple bottom portions 327*a* may be coupled to the same top portion 327*b*.

The holes 321 of the movable support surface 320 are disposed such that each hole 321 is aligned in the process direction (y-axis) with a collection of corresponding platen holes 327. Thus, as the movable support surface 320 moves across the platen 326, each hole 321 will periodically move over a corresponding platen hole 327, resulting in the hole 321 and the platen hole 327 being temporarily vertically aligned (i.e., aligned in a z-axis direction). When a hole 321 moves over a corresponding platen hole 327, the holes 321 and 327 define an opening that fluidically couples the environment above the movable support surface 320 to the low-pressure state in the vacuum plenum 325, thus generating vacuum suction through the holes 321 and 327. This suction generates a vacuum hold down force on a print medium 305 if the print medium 305 is disposed above the holes 321.

As shown in FIGS. 3-5B, the movable support surface 320 has no-suction-regions 351. The no-suction-regions 351 may be used as the no-suction-regions 151 described above in relation to FIG. 2. The no-suction-regions 351 may also be considered as parts of the airflow control system 350. In this embodiment, the no-suction-regions 351 are formed as regions in the belt of the movable support surface 320 that do not have any holes 321. Specifically, the no-suction-regions 351 are regions in the belt in which multiple rows of holes 321 have been omitted from where they would otherwise have been located. In the example of FIGS. 4-5B, each no-suction-region 351 corresponds to six (6) rows of holes 321 that have been omitted, but in other examples fewer or more rows of holes 321 may be omitted, thus making the no-suction-regions 351 wider or narrower. The discussion of the no-suction-regions 151 above is applicable to the no-suction-regions 351, and thus duplicative description is omitted.

The airflow control system 350 also comprises a media registration device 355, which loads print media 305 onto the movable support surface 320 and registers the print media 305 relative to the movable support surface 320. The media registration device 355 is similar to the media registration device 155 described above. The airflow control system 350 also comprises media registration logic (not illustrated) to control operations of the media registration device 355, which is similar to the media registration logic 156 described above. A control system (not illustrated) of the printing system 300 is configured with the media registration logic, in the same manner as described above with respect to the media registration logic 156.

As shown in FIGS. 3-5B, the printing system 300 is configured to register the print media 305 against the no-suction-regions 351, as described above with respect to the no-suction-regions 151. In the embodiment of FIGS. 3-5B, the trail edges of the print media 305 are registered to the no-suction-regions 351. Specifically, the trail edge TE of each print medium 305 is aligned with a datum on a downstream side of one of the no-suction-region 351. Thus, as shown in FIGS. 4 and 5B, the no-suction region 351 to which a print medium 305_1 is registered overlaps with the inter-media zone 322 between that print medium 305_1 and the next print medium 305_2 being transported through the system. Depending on the size of the print media 305 used, the proportion of the inter-media zone 322 that overlaps with the no-suction region 351 will change. For example, if a print medium 305 that is longer than that shown in FIGS. 4 and 5B were used, the lead edge LE of the print medium 305_2 may be located nearer to the upstream boundary of the no-suction region 351. Conversely, if print medium 305 is used that is shorter than that illustrated, the lead edge LE of the print medium 305_2 would be more distant from the upstream boundary of the no-suction region 351.

As shown in FIGS. 4-5B, the airflow control system 350 may optionally also comprise a blocking member 352 to block one of the gaps 309*u* or 309*d*. In the embodiment of FIGS. 4-5B, the trail edge TE of the print media 305 are registered to the no-suction-regions 351, and therefore the blocking members 352 block the upstream gaps 309*u*. In other embodiments, the lead edge LE of the print media 305 are registered to the no-suction-regions 351, and therefore the blocking members 352 block the downstream gaps 309*d*. In still other embodiments, the blocking members 352 are omitted. The blocking member 352 is positioned above the corresponding gap 309*u* or 309*d*, such that it is in contact with or in close proximity to the carrier plate 311 at one end and the printhead 310 at the other end. Thus, the blocking member 352 blocks airflow through the corresponding gap 309*u* or 309*d*. References to "blocking" the gaps, "preventing" air from flowing through gaps, or other similar references, refer to creating a relatively high impedance state through the gap such that airflow through the gap is significantly reduced, as compared to a completely open state (e.g., impedance is increased tenfold and/or airflow is decreased tenfold). Thus, blocking or blocking the gap and preventing airflow through the gap do not necessarily require a hermetic seal or the strict elimination of all airflow. In FIG. 4, the blocking member 352 is disposed above the corresponding gap 309*u* or 309*d*, but in other embodiments the blocking member may be disposed below or within the gap 309*u* or 309*d*. In FIG. 4, one blocking member 352 is provided for each printhead 310. In other embodiments, multiple printheads 310 may share the same blocking member 352. For example, a single blocking member may extend across the printhead module to cover the upstream gaps 309*u* of both of the upstream printheads 310, while the downstream printhead 310 has its own blocking member 352. As another example, a single blocking member may be provide for the entire printhead module 302, and may block the upstream gaps 309*u* of all of the printheads 310 in that module 302.

In some embodiments, the blocking members 352 are omitted and one of the gaps 309*u* or 309*d* is eliminated entirely by positioning the printhead 310 against (e.g., in contact with) the rim of the opening 319 on one side thereof. For example, the upstream gap 309*u* may be eliminated by positioning the printhead 310 against the upstream side of the rim of the opening 319.

As described above, providing no-suction-regions 351 in the movable support surface 320 and registering the trail edge of the print media 305 against the no-suction regions 351 reduces crossflows (and hence image blur) near the trail edges of the print media 305. Moreover, blocking the upstream opening 309*u*, in conjunction with the aforementioned registering of the print media 305 against the no-suction-regions 351, reduces crossflows (and hence image blur) near the lead edges of the print media 305. These phenomena are explained in greater detail below with reference to FIGS. 5A and 5B.

FIG. 5A illustrates a state in which the inter-media zone 322 is located under the printheads 310, with the printhead 310_1 printing on the print medium 305_1 near the trail edge TE thereof. In such a situation, if the countermeasures described herein are not used, then as described above with reference to FIG. 1A the inter-media zone 322 would pull air from the downstream side of the printhead, for example through the downstream gap 309*d* of the printhead 310_1, creating crossflows that may cause image blur. However, because the no-suction-region 351 is provided adjacent to the trail edge TE of the print media 305_1, most of the suction from the inter-media zone 322 is prevented, particularly in the vicinity of the trail edge TE. There is a portion of the inter-media zone 322 that has unblocked holes 321 through which the vacuum suction still flows, but this unblocked portion of the inter-media zone 322 is relatively distant from the downstream side of the printhead 310_1 in the state illustrated in FIG. 5A and thus the suction from this unblocked portion of the inter-media zone has little to no influence in the region near the downstream side of the printhead 310_1. Thus, the crossflows from the downstream side of the printhead 310_1 are not induced, or if induced are relatively weak. Accordingly, image blur near the trail edge TE of the print medium 305_1 is prevented or reduced.

FIG. 5B illustrates another state in which the inter-media zone 322 has advanced further downstream from the state illustrated in FIG. 5A. In this state, the printhead 310_2 is printing on the print medium 305_1 near the trail edge TE, while the printhead 310_1 is printing on the subsequent print medium 305_2 near the lead edge thereof.

In the state illustrated in FIG. 5B, if the countermeasures described herein are not used, then as described above with reference to FIG. 1A, the inter-media zone 322 would pull air from the downstream side of the printhead 310_2, for example through the downstream gap 309*d* of the printhead 310_2, creating crossflows that may cause image blur near the trail edge TE of the print medium 305_1. However, because the no-suction-region 351 is provided adjacent to the trail edge TE of the print media 305_1, crossflows from the downstream side of the printhead 310_2 are prevented or reduced, for the same reasons as described above with respect to FIG. 5A. Thus, image blur near the trail edge TE is prevented or reduced.

In addition, in the state illustrated in FIG. 5B, if the countermeasures described herein are not used, then as described above with reference to FIG. 1D, the inter-media zone 322 would pull air from the upstream side of the printhead 310_1, for example through the upstream gap 309*u* of the printhead 310_1, creating crossflows that may cause image blur near the lead edge LE of the print medium 305_2. However, because the upstream gaps 309*u* of the printhead 310 are blocked (e.g., by blocking members 352), the crossflows that might have otherwise flowed through the upstream gap 309*u* of the printhead 310_1 are prevented. Some crossflows may still flow from the upstream side of the printhead 310_1 to the inter-media zone 322, for example from the region upstream of the printhead module 302, but blocking the upstream gap 309*u* reduces the strength of these crossflows because the impedance between the upstream side of the printhead module 302 is higher than the impedance that would have existed between the upstream gap 309*u* and the inter-media zone 322 if the upstream gap 309*u* were not blocked. In addition, because the downstream gap 309*d* remains unblocked, relief air 314 is able to flow through the downstream gap 309*d* to the unblocked portion of the inter-media zone 322, as shown by the dashed arrows in FIG. 5B. This relief air 314 offsets some of the suction from the inter-media zone 322, thus increasing the pressure in the region above the inter-media zone 322 relative to what it would be absent the relief air 314. This reduces the strength with which air is pulled from other regions, such as from upstream of the printhead 310_1. Thus, the crossflows which were already weakened by the blocking of the upstream gap 309*u* are further weakened by the presence of the relief air 314 from the downstream gap 309*d*. Therefore, the crossflows from the upstream side of the printhead 310 are reduced in strength and image blur near the lead edge LE of the print medium 305_2 is prevented or reduced.

Figure 6:
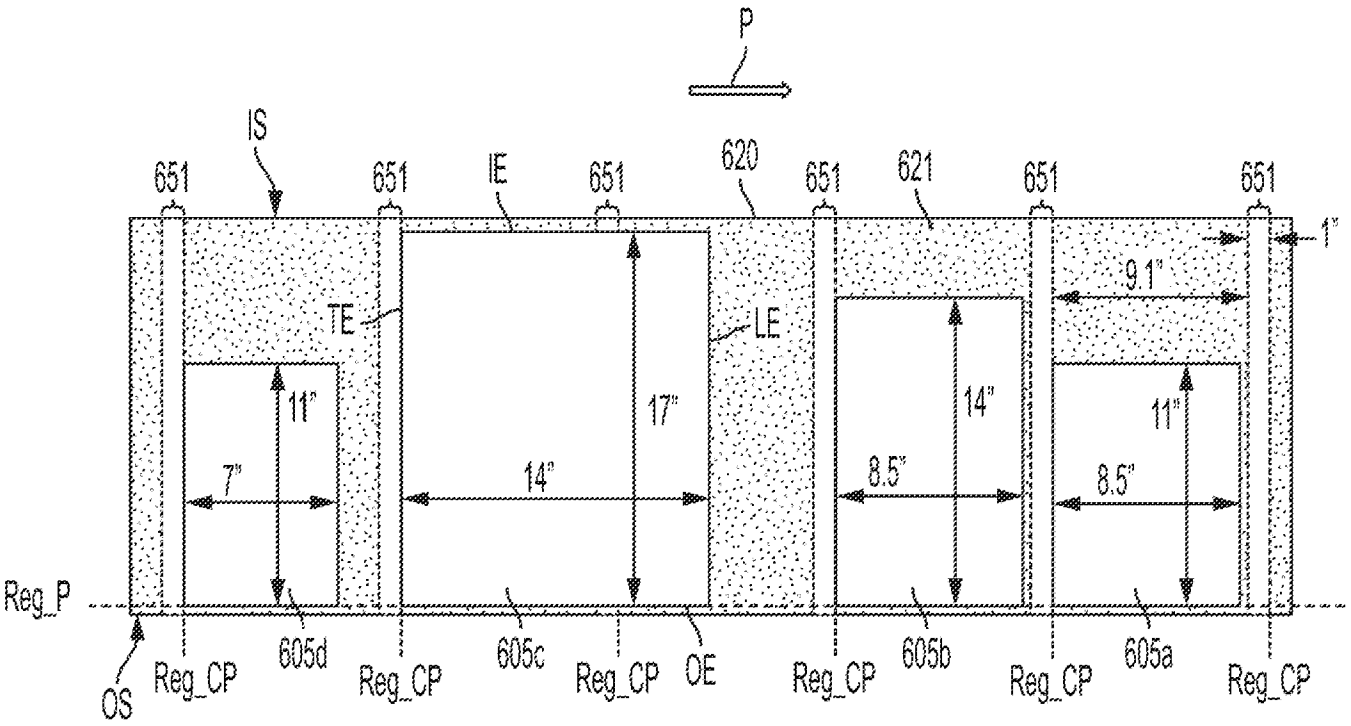
FIG. 6 is a plan view from above a movable support surface of an embodiment of a printing system.

FIG. 6 illustrates an embodiment of a printing system comprising a movable support surface 620. The movable support surface 620 can be used as the movable support surface 320 or the movable support surface 120 described above. FIG. 6 also illustrates an example system for registering print media 605 on the movable support surface 620. This system can be used in any of the printing systems described herein. In particular, the media registration logic 156 of the printing system 100 and/or the media registration logic of the printing system 300 can be configured to register print media similarly to the example illustrated in FIG. 6.

In FIG. 6, a plan view of a segment of the movable support surface 620 is shown, with the segment being depicted in a flat or planar state. However, it should be understood that in practice some portions (or all) of the movable support surface 620 may be curved in the process direction rather than planar, and that one end of the movable support surface 620 may be coupled to the other end of the movable support surface 620 to form a closed loop, for example like the movable support surface 320 depicted in FIG. 3. The movable support surface 620 comprises holes 621, through which vacuum suction is communicated to the print media 605 to hold the print media 605 against the movable support surface 620. The movable support surface 620 also comprises no-suction-regions 651, similar to the no-suction-regions 151 and 351 described above. The no-suction-regions 651 may be regions of the movable support surface 620 in which no holes 621 are present, or in which existing holes 621 are blocked.

As shown in FIG. 6, a process-direction registration datum Reg_P is parallel to the process direction P and positioned near an outboard side OS of the movable support surface. The outboard edges OE of the print media 605 are registered to (aligned with) the process-direction registration datum Reg_P. Thus, as shown in FIG. 6, when different print media 605*a* to 605*d* having different sizes are used, their respective outboard edges OE are all aligned with one another in the process direction but their respective inboard edges IE may not be aligned.

As shown in FIG. 6, there is a cross-process registration datum Reg_CP associated with each of the no-suction-regions 651. In FIG. 6, the cross-process registration datum Reg_CP is aligned with a downstream boundary of the associated no-suction-region 651, and the trail edge TE of each print medium 605 is aligned with one of the cross-process registration datums Reg_CP. Accordingly, the trail edge TE of each print medium 605 is adjacent to one of the no-suction-regions 651. As shown in FIG. 6, when different print media 605*a* to 605*d* having different sizes are used, their respective lead edges may be located differently relative to the no-suction-regions 651. For example, because the print medium 605*d* is shorter than the print medium 605*a* in the process direction, the lead edge of the print medium 605*a* is relatively closer to the next no-suction-region 651 downstream of the print medium 605*a*, while the lead edge of the print medium 605*d* is relatively further from the next no-suction region 651 downstream of the print medium 605*d*.

In some embodiments, including the embodiment of FIG. 6, the no-suction regions 651 are spaced apart in the process direction so as to accommodate all of the sizes of print media 605 that the printing system is configured to use. Specifically, the spacing between no-suction regions 651 is set such that, for each size of print medium 605, when the trail edge TE of the print medium 605 is registered to the no-suction-region 651, the lead edge LE of the print medium 605 does not fall within one of the no-suction regions 651. If the lead edge LE were to fall within a no-suction region 651, this might lead to the lead edge LE lifting off the movable support surface 620 or curling, as any portion of the print medium 605 that is in the no-suction region 651 does not receive suction to hold it down. Thus, in some embodiments, the spacing of the no-suction-regions 651 may be controlled to avoid this occurrence. In FIG. 6, four different print media 605*a* to 605*b* are shown, with each having a different size.

As shown in FIG. 6, the lead edge LE of each of these print media 605*a* to 605*d* does not fall within a no-suction region 351.

One way to ensure the above-noted condition is satisfied is to space the no-suction region 651 apart in the process direction by at least $w_{max}$, where $w_{max}$ is the width in the process direction of the largest print medium 605 the printing system is configured to use. However, in some circumstances, this approach can lead to having relatively large inter-media zones between print media when smaller print media are used, which reduces the number of print media that can be printed per unit time.

Another approach to satisfying the above-noted condition is to space the no-suction regions 651 apart by a distance equal to or slightly longer than $w_{common}$, where $w_{common}$ is a width in the process direction that is the most common amongst the different sizes of print media 605 the system is configured to use (i.e., more types of print media have this width or a similar width) or that is the most popularly used (i.e., the most frequently used print media has this width). Such a spacing may allow for optimizing printing speeds (high number of print media per unit time) for the most print sizes and/or for the most frequently used print sizes, while potentially sacrificing print speeds for some other less common print sizes. For example, in the printing system of FIG. 6, it is expected that the most frequently used size of print media will be the print medium 605*a*. Moreover, in the printing system of FIG. 6, multiple sizes of print media have the same or similar widths as the print medium 605*a* (e.g., the print medium 605*b*). Accordingly, in the example of FIG. 6 the no-suction-regions 651 are spaced apart by a distance that is just slightly larger than the width of the print medium 605*a*. Accordingly, printing speeds for the print media 605*a* and 605*b* are very good because the width of the inter-media zone between adjacent sheets is relatively small. In contrast, the printing speeds for the print media 605*c* are relatively low, as the inter-media zone between adjacent sheets is relatively large.

When the spacing between no-suction-regions 651 is set to something less than $w_{max}$, as in FIG. 6, this will result in some of the larger print media overlapping one or more no-suction-regions 651. For example, in FIG. 6 the print medium 605*c* overlaps one of the no-suction-regions 651. Although this overlapping of the no-suction-region 651 results in a portion of the print medium 605*c* not experiencing any hold-down suction, because the portion that is not held down is in the middle of the print medium 605*c* this is unlikely to cause any problems. In particular, the portion of the print medium 605 that is not receiving suction is very unlikely to lift off the movable support surface 620 because the other portions of the print media surrounding this portion are being actively held down. Thus, as long as the no-suction-region 651 is sufficiently distant from the lead edge LE, there is unlikely to be any problem. In some examples, the spacing between no-suction-regions 651 may be set such that any no-suction-regions 651 that are overlapped by a print medium 605 are at least 10 mm, and in some embodiments around 25 mm, from the lead edge LE.

Above, it was noted that the distance between the sheets may be set to something equal to or slightly larger than the various widths described above. One reason for making the distance slightly larger than these widths, rather than precisely equal to the widths, is to provide some margin of error to account for possibility of the lead edge LE of a print medium 605 being located slightly further downstream than its nominal position. The location of the lead edge LE of a print medium 605 may deviate from its nominally expected position relative to the next no-suction-region 651 due to factors such as: variance in the actual spacings between no-suction-regions 651 from the nominally set spacing due to manufacturing tolerances, variance in the actual spacings between no-suction regions 651 due to stretching or shrinking of the movable support surface 620 due to wear or environmental conditions (e.g., temperature), manufacturing tolerances in the media registration devices which lead to inevitable variance in the registration location of the print media 605 relative to their respective registration datum, etc.

The slight variances in the actual locations of the print media 605 relative to the no-suction regions 651 in real-world systems, as described above, is one reason why it may be advantageous, in some circumstances, to register the trail edge TE of the print media 605 against the no-suction regions 651 rather than registering the lead edge LE of the print media 605 against the no-suction regions 651. If the trail edge TE is positioned over the no-suction region 651 due to the variances described above or due to some other factor, this is unlikely to cause a problem because the tail edge TE is unlikely to lift off the movable support surface 620 even if it is not subjected to suction as the direction of movement of the print media 605 results in the air around the print media 605 tending to push the print media 605 down into the movable support surface 620. Moreover, the trail edge TE is unlikely to cause a jam even if it does lift off the movable support surface, as the trail edge TE would likely just be pushed back down to the movable support surface as the lead edge LE continues to be pulled forward. In contrast, if the lead edge LE were registered to the no-suction regions 651, then the inevitable variances in location of the print media 605 relative to their nominal locations could result in the lead edge LE being located above a no-suction-region 651. This could potentially allow the lead edge LE to lift off the movable support surface 620, potentially resulting in curling of the print media or causing a jam. Nevertheless, although registering the trail edge TE to the no-suction regions may be advantageous in some circumstances, in some embodiments the lead edge is registered to the no-suction regions.

In one embodiment, the print medium 605*a* in FIG. 6 corresponds to an 8.5 inches (in.)×11 inches (in.) dimensioned substrate, the print medium 605*b* corresponds to an 8.5 in.×14 in. substrate, the print medium 605*c* corresponds to a 14 in.×17 in. substrate, and the print medium 605*d* corresponds to a 7 in.×11 in. substrate. In this embodiment, the spacing between no-suction-regions is about 230 mm (about 9.1 inches), and the width of each no-suction-region is about 25 mm (about 1 inch). This allows for a variety of commonly used types of print media to be registered to the no-suction-regions 651 without having their lead edge LE fall within a no-suction region 651, while also optimizing printing speed for the 8.5 in.×11 in. substrates, which is one of the most commonly used types of print media 605. It should be understood that the principles described above and illustrated in FIG. 6 are applicable to other sizes of print media, other sizes of no-suction-regions 651, and other spacings between no-suction regions 651. Different systems may be optimized around different sizes of print media. For example, a print media that is considered a most-commonly used print media may vary from one system to the next, depending on the intended use-case for the system and/or the intended geographic region in which the system may be commercialized. For example, systems intended for sale/use in a particular geographic region or field-of-use may have no-suction regions configured based on commonly used print media in that region or field-of-use, while systems intended for sale/use in other regions or fields-of-use may have differently configured no-suction-regions. As an example, 8.5 in.×11 in. substrates may be more common in North America, while A3 and A4 sized substrates may be more common in Europe. As another example, a system intended primarily for use in home or office printing may use a different range of sizes of print media and may have a different most-common type of print media than a system intended primarily for use in industrial printing.

Figure 7A:
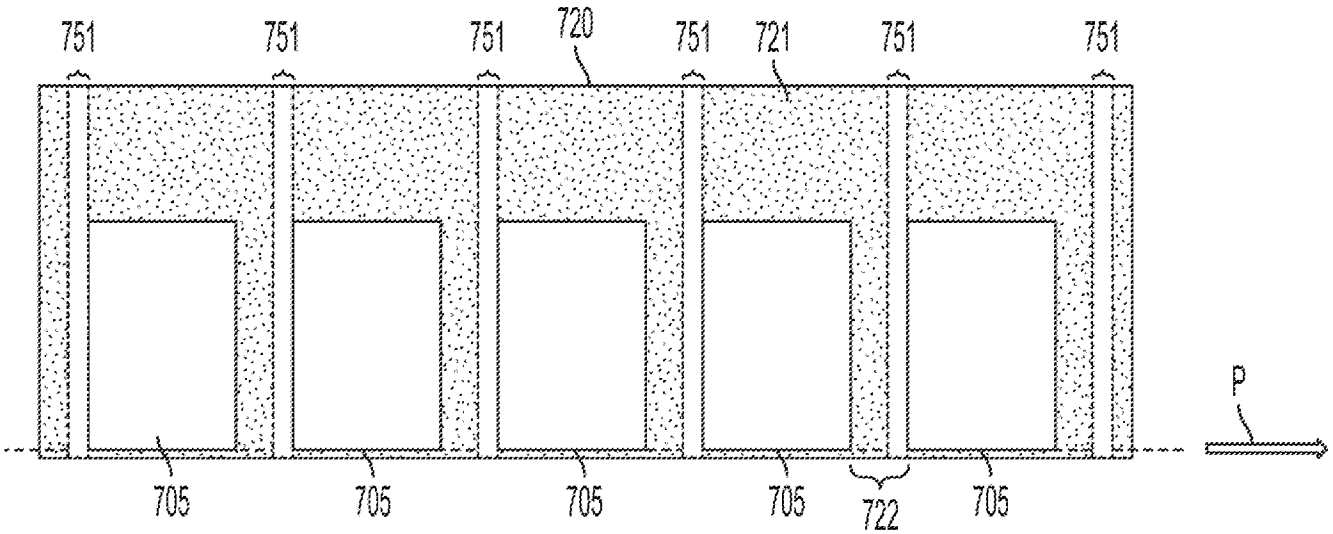
FIGS. 7A-7B are plan views from above a movable support surface of an embodiment of a printing system.
Figure 7B:
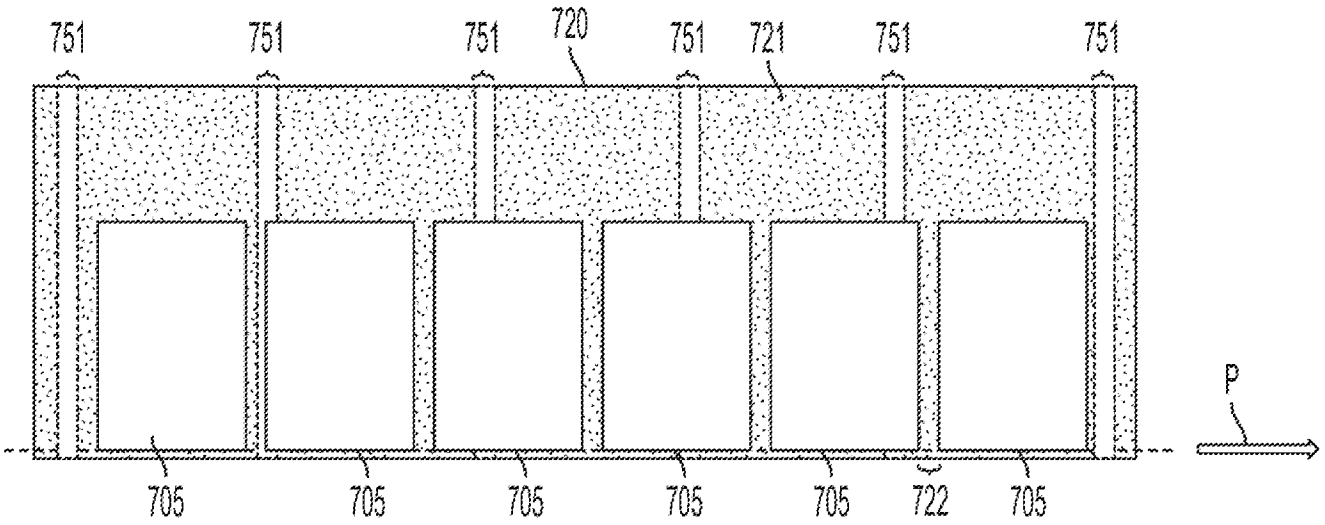

As noted above, in some embodiments the printing system may be configured to select between different registration schemes based on different user settings or different detected conditions. FIGS. 7A and 7B illustrate such an example. In FIG. 7A, a registration scheme is illustrated in which the trail edge of each print medium 705 is registered to one of the no-suction-regions 751, similar to FIG. 6. This registration scheme is intended to combat image blur near the trail edge, and thus is referred to herein as a blur-optimized registration scheme. However, as already noted above, such a blur-optimized registration scheme might result in slightly lower print speeds (e.g., sheets per unit time) than would otherwise be possible.

In contrast, in FIG. 7B a registration scheme is illustrated in which print speed is prioritized over blur reduction, which is referred to herein as a speed-optimized registration scheme. In the speed-optimized registration scheme, the cross-process registration datums are arranged such that the lead edge of each print medium 705 is a predetermined distance from the trail edge of the adjacent print medium 705. This results in an inter-media zone 722 having a predetermined width equal to the aforementioned distance. Importantly, in the speed-optimized registration scheme, the width of the inter-media zone 722 may be controlled independently of the size of the print media 705, and the width can potentially be set smaller than would be possible in the blur-optimized registration scheme. In the blur-optimized registration scheme the width of the inter-media zone 722 is defined entirely by the fixed spacing between no-suction-regions 751 and the width of the print media 705. Thus, in the blur-optimized registration scheme the width of the inter-media zone 722 cannot be selectively controlled, and the width can be relatively large in cases in which the selected print medium 705 is particularly narrow. But in the speed-optimized registration scheme, because the width of the inter-media zone 722 can be freely set without regard to the size of the print media 705, a relatively small inter-media zone 722 can be used. For example, the smallest inter-media zone 722 that the printing system is designed to handle can be used. Using a smaller inter-media zone 722 allows more print media 705 to fit within the same given length of the movable support surface 720, and hence increases the number of print media 705 that are printed per given unit of time (assuming a constant speed for the movable support surface 720). For example, comparing FIGS. 7A and 7B, it can be seen that using the blur-optimized registration scheme (FIG. 7A), five of the print media 705 fit within a given length of the movable support surface 720, corresponding to a print speed of five media per given unit time, while using the speed-optimized registration scheme (FIG. 7B) six of the print media 705 fit within the same length, corresponding to a print speed of six media per given unit time. The difference in print speed between the blur-optimized registration scheme and the speed-optimized registration scheme may vary from one type of print media to the next. For example, if a print medium 705 has a width that is approximately equal to the spacing between no-suction-regions 751 (such as the print media 605*a* and 605*b* from FIG. 6), then speed in the blur-optimized registration scheme may be similar to the speed in the speed-optimized registration scheme. However, for print media 705 that are particularly narrow relative to the spacing between no-suction-regions 751 (such as the print medium 605*d* from FIG. 6) and for print media 705 that are wider than the spacing between no-suction-regions 751 (such as the medium 605*c* from FIG. 6), there may be a non-trivial increase in print speed when switching from the blur-optimized registration scheme to the speed in the speed-optimized registration scheme. Of course, a drawback of the speed-optimized registration scheme is that the blur reduction effects near the trail edge are lost. In some circumstances, print speed may be prioritized over such blur reduction effects, and in other circumstances the opposite might be the case.

In some embodiments, the printing system may allow for a selection among a number of registration schemes, which may include, for example, a blur-optimized registration scheme and a speed optimized registration such as those described above. In some embodiments, one of the registration schemes may be a default scheme, and another scheme can be selected as desired based on various factors relating to the particular print job. In some embodiments, the printing system may be configured to provide feedback of a print speed associated with each of the registration schemes, in view of the selected print media, to help determine which scheme may be preferred under a given set of conditions.

In some embodiments, the selection of registration scheme may be manually made by a user, while in other embodiments, a control system of the printing system may automatically select between the registration schemes based on detected conditions. For example, the control system may consider the location of image content that is to be printed, selecting the blur-optimized scheme when images are being printing close to the trail edge and selecting the speed-optimized scheme when images are not being printed near the trail edge. As another example, the control system may consider the type of image content being printed, and may select the blur-optimized scheme when images that are particularly sensitive to blur are being printed, such as bar codes or fine lines. As another example, the control system may receive real time feedback of the amount of image blur in printed images, and may switch from a speed-optimized scheme to the blur-optimized scheme if the amount of blur that is detected reaches a threshold. The blur may be detected, for example, by obtaining an electronic image of the printed images (e.g., via an inline scanner) and performing image processing on the electronic image to detected blur (e.g., detecting an edge of an inked area in the image and quantifying the amount of ink dots or dark pixels that fall outside of the edge). In some embodiments, in addition to the system automatically selecting a registration scheme, the system may also allow a user to manually select a registration scheme, which when selected overrides the system-selected scheme.

This description and the accompanying drawings that illustrate inventive aspects and embodiments should not be taken as limiting—the claims define the protected invention. Various mechanical, compositional, structural, electrical, and operational changes may be made without departing from the spirit and scope of this description and the claims. In some instances, well-known circuits, structures, and techniques have not been shown or described in detail in order not to obscure the invention. Like numbers in two or more figures represent the same or similar elements.

Further, the terminology used herein to describe aspects of the invention, such as spatial and relational terms, is chosen to aid the reader in understanding embodiments of the invention but is not intended to limit the invention. For example, spatially terms—such as "beneath", "below", "lower", "above", "upper", "inboard", "outboard", "up", "down", and the like—may be used herein to describe directions or one element's or feature's spatial relationship to another element or feature as illustrated in the figures. These spatial terms are used relative to the poses illustrated in the figures, and are not limited to a particular reference frame in the real world. Thus, for example, the direction "up" in the figures does not necessarily have to correspond to an "up" in a world reference frame (e.g., away from the Earth's surface). Furthermore, if a different reference frame is considered than the one illustrated in the figures, then the spatial terms used herein may need to be interpreted differently in that different reference frame. For example, the direction referred to as "up" in relation to one of the figures may correspond to a direction that is called "down" in relation to a different reference frame that is rotated 180 degrees from the figure's reference frame. As another example, if a device is turned over 180 degrees in a world reference frame as compared to how it was illustrated in the figures, then an item described herein as being "above" or "over" a second item in relation to the Figures would be "below" or "beneath" the second item in relation to the world reference frame. Thus, the same spatial relationship or direction can be described using different spatial terms depending on which reference frame is being considered. Moreover, the poses of items illustrated in the figure are chosen for convenience of illustration and description, but in an implementation in practice the items may be posed differently.

The term "process direction" refers to a direction that is parallel to and pointed in the same direction as an axis along which the print media moves as is transported through the deposition region of the ink deposition assembly. Thus, the process direction is a direction parallel to the y-axis in the Figures and pointing in a positive y-axis direction.

The term "cross-process direction" refers to a direction perpendicular to the process direction and parallel to the movable support surface. At any given point, there are two cross-process directions pointing in opposite directions, i.e., an "inboard" cross-process direction and an "outboard" cross-process direction. Thus, considering the reference frames illustrated in the Figures, a cross-process direction is any direction parallel to the x-axis, including directions pointing in a positive or negative direction along the x-axis. References herein to a "cross-process direction" should be understood as referring generally to any of the cross-process directions, rather than to one specific cross-process direction, unless indicated otherwise by the context. Thus, for example, the statement "the valve is movable in a cross-process direction" means that the valve can move in an inboard direction, outboard direction, or both directions.

The terms "upstream" and "downstream" may refer to directions parallel to a process direction, with "downstream" referring to a direction pointing in the same direction as the process direction (i.e., the direction the print media are transported through the ink deposition assembly) and "upstream" referring to a direction pointing opposite the process direction. In the Figures, "upstream" corresponds to a negative y-axis direction, while "downstream" corresponds to a positive y-axis direction. The terms "upstream" and "downstream" may also be used to refer to a relative location of element, with an "upstream" element being displaced in an upstream direction relative to a reference point and a "downstream" element being displaced in a downstream direction relative to a reference point. In other words, an "upstream" element is closer to the beginning of the path the print media takes as it is transported through the ink deposition assembly (e.g., the location where the print media joins the movable support surface) than is some other reference element. Conversely, a "downstream" element is closer to the end of the path (e.g., the location where the print media leaves the support surface) than is some other reference element. The reference point of the other element to which the "upstream" or "downstream" element is compared may be explicitly stated (e.g., "an upstream side of a printhead"), or it may be inferred from the context.

The terms "inboard" and "outboard" refer to cross-process directions, with "inboard" referring to one to cross-process direction and "outboard" referring to a cross-process direction opposite to "inboard." In the Figures, "inboard" corresponds to a positive x-axis direction, while "outboard" corresponds to a negative x-axis direction. The terms "inboard" and "outboard" also refer to relative locations, with an "inboard" element being displaced in an inboard direction relative to a reference point and with an "outboard" element being displaced in an outboard direction relative to a reference point. The reference point may be explicitly stated (e.g., "an inboard side of a printhead"), or it may be inferred from the context.

The term "vertical" refers to a direction perpendicular to the movable support surface in the deposition region. At any given point, there are two vertical directions pointing in opposite directions, i.e., an "upward" direction and an "downward" direction. Thus, considering the reference frames illustrated in the Figures, a vertical direction is any direction parallel to the z-axis, including directions pointing in a positive z-axis direction ("up") or negative z-axis direction ("down").

The term "horizontal" refers to a direction parallel to the movable support surface in the deposition region (or tangent to the movable support surface in the deposition region, if the movable support surface is not flat in the deposition region). Horizontal directions include the process direction and cross-process directions.

The term "vacuum" has various meanings in various contexts, ranging from a strict meaning of a space devoid of all matter to a more generic meaning of a relatively low pressure state. Herein, the term "vacuum" is used in the generic sense, and should be understood as referring broadly to a state or environment in which the air pressure is lower than that of some reference pressure, such as ambient or atmospheric pressure. The amount by which the pressure of the vacuum environment should be lower than that of the reference pressure to be considered a "vacuum" is not limited and may be a small amount or a large amount. Thus, "vacuum" as used herein may include, but is not limited to, states that might be considered a "vacuum" under stricter senses of the term.

The term "air" has various meanings in various contexts, ranging from a strict meaning of the atmosphere of the Earth (or a mixture of gases whose composition is similar to that of the atmosphere of the Earth), to a more generic meaning of any gas or mixture of gases. Herein, the term "air" is used in the generic sense, and should be understood as referring broadly to any gas or mixture of gases. This may include, but is not limited to, the atmosphere of the Earth, an inert gas such as one of the Noble gases (e.g., Helium, Neon, Argon, etc.), Nitrogen ($N_2$) gas, or any other desired gas or mixture of gases.

In addition, the singular forms "a", "an", and "the" are intended to include the plural forms as well, unless the context indicates otherwise. And, the terms "comprises", "comprising", "includes", and the like specify the presence of stated features, steps, operations, elements, and/or components but do not preclude the presence or addition of one or more other features, steps, operations, elements, components, and/or groups. Components described as coupled may be electrically or mechanically directly coupled, or they may be indirectly coupled via one or more intermediate components, unless specifically noted otherwise. Mathematical and geometric terms are not necessarily intended to be used in accordance with their strict definitions unless the context of the description indicates otherwise, because a person having ordinary skill in the art would understand that, for example, a substantially similar element that functions in a substantially similar way could easily fall within the scope of a descriptive term even though the term also has a strict definition.

Elements and their associated aspects that are described in detail with reference to one embodiment may, whenever practical, be included in other embodiments in which they are not specifically shown or described. For example, if an element is described in detail with reference to one embodiment and is not described with reference to a second embodiment, the element may nevertheless be claimed as included in the second embodiment.

It is to be understood that the particular examples and embodiments set forth herein are non-limiting, and modifications to structure, dimensions, materials, and methodologies may be made without departing from the scope of the present teachings.

Other embodiments in accordance with the present disclosure will be apparent to those skilled in the art from consideration of the specification and practice of the inventions disclosed herein. It is intended that the specification and embodiments be considered as exemplary only, with the following claims being entitled to their fullest breadth, including equivalents, under the applicable law.

What is claimed is:

1. A printing system, comprising:

an ink deposition assembly comprising a printhead arranged to eject a print fluid to a deposition region of the ink deposition assembly;

a media transport assembly comprising a movable support surface with holes through the movable support surface, a media registration device, and a source of vacuum suction, wherein the media registration device is configured to load print media onto the movable support surface and register the print media to locations of the movable support surface, each of the print media having a lead edge and a trail edge, wherein the media transport assembly is configured to hold the print media against the movable support surface by vacuum suction through the holes and transport the print media along a process direction though the deposition region, and wherein the movable support surface comprises no-suction-regions in which the vacuum suction is prevented, the no-suction-regions extending in a cross-process direction across the movable support surface and being distributed along the movable support surface in the process direction; and a control system configured to cause the media registration device to register the lead edge or the trail edge of each of the print media relative to a respective one of the no-suction-regions, wherein there is an upstream gap between an upstream face of the printhead and a rim of the printhead opening and a downstream gap between a downstream face of the printhead and the rim of the printhead opening, and wherein:

the upstream gap is blocked to passage of airflow and the downstream gap is open to passage of airflow and the control system is configured to cause the media registration device to register the trail edge of each of the print media against a respective one of the no-suction-regions, or the downstream gap is blocked to passage of airflow and the upstream gap is open to passage of airflow and the control system is configured to cause the media registration device to register the lead edge of each of the print media against a respective one of the no-suction-regions.

2. The printing system of claim 1, wherein the control system is configured to cause the media registration device to register the trail edge of each of the print media against a respective one of the no-suction-regions.

3. The printing system of claim 1, wherein each of the no-suction-regions comprises a portion of the movable support surface that does not include any of the holes.

4. The printing system of claim 3, wherein the holes are arranged in the process direction in rows extending perpendicular to the process direction, and each no-suction-region extends in the process direction at least a length equivalent to a length of a region occupied by two or more rows of the holes.

5. The printing system of claim 3, each no-suction-region extends in the process direction at least a length equivalent to a length of the printhead in the process direction.

6. The printing system of claim 1, wherein each of the no-suction-regions comprises a respective portion of the movable support surface comprising a respective subset of the holes, and each one of the holes that is located in any one of the no-suction regions is blocked.

7. The printing system of claim 6, wherein the holes are arranged in the process direction in rows extending perpendicular to the process direction, and each no-suction-region comprises at least two or more rows of the holes.

8. The printing system of claim 7, each no-suction-region extends in the process direction at least a length equivalent to a length of the printhead in the process direction.

9. The printing system of claim 1, wherein the control system is configured to cause the media registration device to change between a first registration scheme comprising registering each of the print media relative to a respective one of the no-suction-regions and second registration scheme comprising registering the print media such that the lead edge of each of the print media is a predetermined distance from the trail edge of previous one of the print media.

10. The printing system of claim 9, wherein the control system is configured to select between the first and second registration schemes based on a user selection.

11. The printing system of claim 9, wherein the control system is configured to select between the first and second registration schemes based on detected conditions.

12. The printing system of claim 1, wherein the no-suction-regions are sized and spaced apart in the process direction such that, for each size of print media that the printing system is configured to use, when the trail edge of a print medium is registered against one of the no-suction-regions the lead edge of the print medium is not located in any of the no-suction-regions.

13. The printing system of claim 1, wherein the media transport assembly comprises a vacuum platen supporting the movable support surface, the vacuum platen comprising platen holes that communicate the vacuum suction to the movable support surface; and wherein the movable support surface comprises a belt configured to move over a surface of the vacuum platen.

14. A method, comprising:

loading a print medium onto a movable support surface of a media transport assembly of a printing system, wherein the print medium is held against the movable support surface via vacuum suction through holes in the movable support surface, wherein the movable support surface comprises no-suction-regions in which the vacuum suction is prevented in the no-suction regions, and wherein the no-suction-regions extend in a cross-process direction across the movable support surface and are distributed along the movable support surface in the process direction;

registering a trail edge of the print medium against one of the no-suction-regions;

transporting the print medium, via the movable support surface, in a process direction through a deposition region of a printhead of the printing system; and ejecting print fluid from the printhead to deposit the print fluid to the print medium in the deposition region.

15. A method, comprising:

loading a print medium onto a movable support surface of a media transport assembly of a printing system, the print medium comprising a lead edge and a trail edge, wherein the print medium is held against the movable support surface via vacuum suction through holes in the movable support surface, wherein the movable support surface comprises no-suction-regions in which the vacuum suction is prevented in the no-suction regions, and wherein the no-suction-regions extend in a cross-process direction across the movable support surface and are distributed along the movable support surface in the process direction;

selecting a media registration scheme out of multiple media registration schemes the printing system is configured to use, the multiple media registration schemes including a first media registration scheme in which the trail edge of each print medium is registered against one of the no-suction-regions;

registering the print medium using the selected media registration scheme;

transporting the print medium, via the movable support surface, in a process direction through a deposition region of a printhead of the printing system; and ejecting print fluid from the printhead to deposit the print fluid to the print medium in the deposition region.

16. The method of claim 15, wherein the multiple media registration schemes include a second registration scheme in which print media are registered such that the lead edge of each print medium is a predetermined distance from the trail edge of previous print medium.

17. A method of transporting print media through a printing system, the method comprising:

generating vacuum suction;

communicating the vacuum suction through one or more first regions of a movable support surface moving through an ink deposition region of the printing system to apply a suction force;

preventing the vacuum suction from being communicated through one or more second regions of the movable support surface moving through the ink deposition region;

loading a print medium to the movable support surface and registering a lead edge or a trail edge of the print medium relative to one of the second regions, such that the print medium is held against the movable support surface by the suction force through the one or more first regions;

transporting the print medium through the ink deposition region via the movable support surface; and ejecting print fluid from a printhead to deposit the print fluid to the print medium in the ink deposition region.

* * * * *